US011815250B2

(12) United States Patent
Hierzer

(10) Patent No.: US 11,815,250 B2
(45) Date of Patent: Nov. 14, 2023

(54) RAIL LIGHTING ARRANGEMENT WITH COUPLING UNIT

(71) Applicant: H4X e.U., Graz (AT)

(72) Inventor: Andreas Hierzer, Graz (AT)

(73) Assignee: H4X e.U., Graz (AT)

( * ) Notice: Subject to any disclaimer, the term of this patent is extended or adjusted under 35 U.S.C. 154(b) by 0 days.

(21) Appl. No.: 17/700,637

(22) Filed: Mar. 22, 2022

(65) Prior Publication Data

US 2022/0307676 A1 Sep. 29, 2022

(30) Foreign Application Priority Data

Mar. 25, 2021 (DE) ..... 102021202975.2

(51) Int. Cl.
*F21V 21/34* (2006.01)
*F21V 23/06* (2006.01)

(52) U.S. Cl.
CPC ..... *F21V 21/34* (2013.01); *F21V 23/06* (2013.01)

(58) Field of Classification Search
CPC .... H01R 25/14; H01R 25/145; H01R 25/162; F21V 23/003; F21V 19/0025; F21V 23/06; F21V 21/34
See application file for complete search history.

(56) References Cited

U.S. PATENT DOCUMENTS 3,559,146 A * 1/1971 Valtonen ..... H01R 25/14 439/94
4,130,860 A * 12/1978 Careglio ..... F21V 23/00 362/217.08
5,013,251 A * 5/1991 Stringer ..... H01R 25/14 439/94
5,521,805 A * 5/1996 Lim ..... F21V 23/06 362/217.08
7,513,640 B2 * 4/2009 Hendrikus ..... F21V 23/06 362/225
7,744,386 B1 * 6/2010 Speidel ..... H01R 25/145 439/118
8,061,865 B2 * 11/2011 Piepgras ..... F21V 29/83 362/292

(Continued)

FOREIGN PATENT DOCUMENTS

DE 102009037763 A1 2/2011
DE 102009037764 A1 2/2011

(Continued)

OTHER PUBLICATIONS

Office Action issued in the corresponding Austrian patent application 50241/2021 dated Jun. 23, 2022 (pp. 1-3).

(Continued)

*Primary Examiner* — Ismael Negron
(74) *Attorney, Agent, or Firm* — MILLEN, WHITE, ZELANO & BRANIGAN, P.C.; William Nixon

(57) ABSTRACT

A rail lighting arrangement includes a rail, an additional component such as, for instance, a lighting module and a coupling unit. The rail has an inner region and a web that is provided with an opening. A conductor device is provided. The coupling unit is configured to be received by the rail and electrically connect to the conductor device. The coupling unit has a contacting section that is configured to be received in or pass through the opening in the web.

17 Claims, 13 Drawing Sheets

(56) References Cited

U.S. PATENT DOCUMENTS

| | | | | |
|---|---|---|---|---|
| 8,220,953 | B1 * | 7/2012 | Moore | F21V 17/002 362/217.01 |
| 9,845,942 | B2 * | 12/2017 | Ladstaetter | H01R 25/142 |
| 11,448,386 | B2 * | 9/2022 | Booth | F21V 23/008 |
| 2007/0285949 | A1 * | 12/2007 | Lodhie | H01R 25/142 362/648 |
| 2014/0049954 | A1 | 2/2014 | Ladstaetter | |
| 2018/0313503 | A1 | 11/2018 | Sonneman | |
| 2022/0307662 | A1 * | 9/2022 | Hierzer | F21V 21/35 |
| 2022/0307679 | A1 * | 9/2022 | Hierzer | H01R 35/04 |

FOREIGN PATENT DOCUMENTS

| | | | |
|---|---|---|---|
| DE | 102011017702 | A1 | 10/2012 |
| DE | 102013226950 | A1 | 6/2015 |
| DE | 202014100952 | U1 | 6/2015 |
| EP | 2287978 | B1 | 3/2020 |
| WO | 2022112403 | A2 | 6/2022 |

OTHER PUBLICATIONS

Search report in corresponding EP 22 15 7399 dated Jul. 25, 2022 (pp. 1-2).

* cited by examiner

RAIL LIGHTING ARRANGEMENT WITH COUPLING UNIT

FIELD OF THE INVENTION

The invention relates to a lighting arrangement having a rail and a coupling unit for a lighting arrangement having a rail, in particular for lighting purposes within buildings, e.g. in internal rooms thereof.

TECHNICAL BACKGROUND

Lighting arrangements based on rail systems, for instance for lighting purposes in buildings, are already known. For example, systems have already been proposed, in which electrical conductors are integrated into a rail profile to provide a supply voltage and control signals. Such rail systems include e.g. a number of light insets of a different type, e.g. spotlights or linear light insets, which can also be combined.

Furthermore, e.g. EP 3 336 420 B1 describes a lighting system which comprises a channel for accommodating a lighting unit which can be inserted therein. A connector which can be inserted into the channel is designed to electrically couple conductor rail sections to one another. In the state of being inserted into the channel, the lighting unit and the connector can be arranged in an overlapping manner within the channel.

EP 3 495 726 A1 describes a lighting device having a connecting body which can be mechanically and electrically connected to a guide and which can be inserted into and removed from the guide at least in a direction perpendicular to the longitudinal extension of the guide.

Furthermore, e.g. EP 3 217 090 B1 describes an adapter which is intended to support a lighting device and electrically connect it to an electrified rail.

Furthermore, EP 3 719 394 A1 describes a lighting apparatus having a light and an adapter. The adapter serves to connect the light to a rail as a support. A connecting section of the adapter has a displacement element which can be connected in a displaceable manner to the rail serving as a support. The light has, for its part, a guide rail with first electrical contacts, while the adapter has a carriage with second electrical contacts, which is connected in a displaceable manner to the guide rail. An intermediate section is provided between the carriage and the connecting section and defines a pivot joint between the carriage and the connecting section.

In addition, a rail system has already been proposed which can be mounted in a suspended manner and can provide an additional indirect lighting component.

However, the installation of the components which provide the indirect part of the light is in many cases normally possible only in an inflexible way and/or for relatively high outlay.

This is a situation which needs to be remedied.

SUMMARY OF THE INVENTION

Against this background, the object of the invention is to provide a lighting arrangement which renders it possible to easily provide an indirect part of the light. Furthermore, a coupling unit for the formation of a lighting arrangement is to be provided which renders it possible to easily effect coupling to another component of the lighting arrangement, such as e.g. a component for indirect lighting.

In accordance with the invention, this object is achieved by a lighting arrangement with the features of claim 1 and/or by a coupling unit with the features of claim 15.

A lighting arrangement is proposed having a rail, at least one indirect lighting module and a coupling unit.

The rail is designed for coupling-on and/or at least partially accommodating at least one lighting module or at least one lighting unit and comprises an inner region in which, along the rail, a conductor device is provided at least for providing electrical energy for supplying the lighting module or the lighting unit The indirect lighting module is provided for the provision of indirect lighting. The coupling unit can be coupled to the rail and is arranged at least to receive electrical energy from the conductor device and to supply the indirect lighting module with electrical energy. In this case, the rail comprises a web which is designed as a limit of the inner region of the rail fitted with the conductor device. In the region of the web, the rail comprises a passage-opening. The coupling unit comprises a contacting section which can be passed through the passage-opening in order to bring about an electrical coupling of the indirect lighting module to the coupling unit.

Furthermore, a coupling unit for a lighting arrangement, in particular such a lighting arrangement in accordance with the invention, is proposed. The coupling unit can be inserted into a rail of the lighting arrangement and can be coupled to the rail. In this case, the coupling unit comprises a first contact device to come into electrically conductive contact with conductors of a conductor device extending along the rail. Furthermore, the coupling unit comprises a contacting section designed to be introduced into a passage-opening in a web of the rail during insertion of the coupling unit into the rail. A second contact device, arranged on the contacting section, is in this case provided to come into electrically conductive contact with a contact device of another component and to electrically couple the coupling unit to the other components. The other components can be in particular an indirect lighting module.

The invention is based on the concept that by providing a passage-opening in a web of a rail and introducing a contacting section of a coupling unit into the passage-opening, a considerably simplified supply to the other component, which is designed in particular as an indirect lighting module, is achieved. In particular, an advantageous simplification can be achieved when the other component is to be arranged on the other side of the web in relation to the coupling unit.

The supply to the other component, in particular to the indirect lighting module, therefore does not require conventional cumbersome cabling at a location fixedly predefined in the factory, and carried out e.g. at the construction site, but can rather be considerably simplified by means of the incorporation of the passage-opening—such as in the form of a pre-produced opening in the web, or by the flexible incorporation thereof at the construction site—and the use of the passage-opening for electrical coupling.

In order to supply the other component it is thus possible advantageously to use the conductor device in the inner region of the rail, and the production of the contact requires in particular only a few hand movements.

Advantageous embodiments and developments of the invention are apparent from the further dependent claims and from the description with reference to the figures.

In one embodiment, the coupling unit and the indirect lighting module for the electrical coupling are arranged with each other in such a way that the indirect lighting module can be displaced in a longitudinal direction of the rail relative to the coupling unit coupled to the rail. This renders possible adaptations with respect to the position of the indirect lighting module along the rail even after completed insertion of the coupling unit and the electrical coupling of the coupling unit and indirect lighting module.

In particular, the contacting section is arranged on one side of the coupling unit which faces the web when the coupling unit is in a state inserted into the rail. This contributes to simple insertion.

In a preferred embodiment, the contacting section is designed as a projection of a body of the coupling unit. In particular, the contacting section is rigidly arranged on the coupling unit. This can also contribute to simple expedient facility of handling of the coupling unit.

In some embodiments, the cabling outlay for the supply to the other component, in particular to the indirect lighting module, can be reduced considerably or cabling for this purpose can even be avoided entirely.

In one embodiment, the coupling unit comprises contact elements, in particular punctiform contact elements, the cooperation of which with allocated elongated contact elements of the indirect lighting module renders it possible to effect the—in particular displaceable—electrical coupling to the indirect lighting module. In particular, the contact elements of the coupling unit are provided on the contacting section of same. In one indirect lighting module, which is given by way of example and is designed in a rather elongated manner, contact elements of an elongated design are for instance simply to be provided relative thereto and a comparatively compact contacting section becomes possible. Such an embodiment can help to avoid cabling outlay and renders possible particularly simple and rapid installation.

In one development, the elongated contact elements extend with their longitudinal direction in the longitudinal direction of the rail when the indirect lighting module is in a state coupled to the rail. This advantageously contributes to a simple and expedient displaceable coupling.

In particular, the elongated contact elements of the indirect lighting module are strip-like.

In a further preferred manner, the elongated contact elements of the indirect lighting module are arranged on one side thereof which faces the coupling unit when the coupling unit is inserted into the rail and the indirect lighting module is coupled to the rail. This renders possible a further simplification of the electrical coupling of the indirect lighting module and of the coupling unit.

In one development, the contact elements of the coupling unit are designed in a pin-like or pin-head-like manner.

In one embodiment, the indirect lighting module has a double-sided printed circuit board, wherein the contact elements of the indirect lighting module are formed as tracks on a main surface of the printed circuit board. Such contact elements can be expediently produced.

In particular, the double-sided printed circuit board is provided with light-generation devices, e.g. LEDs, on its other main surface. In particular, the functions of light generation and establishing contact with the contact elements of the coupling unit can therefore be combined on the double-sided printed circuit board, which can contribute to a saving of space and installation layout.

According to another embodiment, the coupling unit and the indirect lighting module for achieving the electrical coupling thereof are arranged by means of cabling. Such an embodiment can be implemented inexpensively and, in particular by reason of the flexible positioning capability of the passage-opening, can contribute to achieving coupling in a simple and uncomplicated manner even when cabling is used.

In developments, the passage-opening of the rail, which is provided for the coupling of the coupling unit and of the indirect lighting module, can be introduced into the rail in the factory or on site during installation of the lighting arrangement. In particular, the passage-opening can be incorporated at any point along the web by a method which is easily possible for a fitter or skilled worker, e.g. by drilling. In this way a high degree of flexibility in the positioning of the coupling unit(s) and lighting module can be achieved.

In one embodiment, the conductor device is arranged in the inner region of the rail in such a way that the conductor of the conductor device is located to the side of the coupling unit when the coupling unit is inserted into the inner region of the rail. The conductors can extend in the inner region, in particular along longitudinal side walls of the rail, e.g. on both sides of the coupling unit when it is in its state inserted into the inner region. Such an arrangement of the conductors facilitates the production of the electrical contact between the coupling unit and the indirect lighting module and can be designed in a compact and space-saving manner.

In one embodiment, the conductor device is further arranged for the provision of a control signal, wherein the coupling unit is arranged to receive the control signal from the conductor device and to transmit a signal to the indirect lighting module for control thereof and/or to control the indirect lighting module. In particular, the coupling unit can be arranged to relay the received control signal to the indirect lighting module, or can be arranged to interpret the received control signal and, on the basis of the received control signal, to control the indirect lighting module and/or, on the basis of the received control signal, to form a signal to be transmitted to the indirect lighting module and to transmit it to the indirect lighting module.

Contact devices—which can be brought into operative connection with each other—of the coupling unit and of the indirect lighting module can be designed in particular for the relaying of the control signal or the transmission of the signal formed on the basis of the control signal.

In a preferred embodiment, the conductors of the conductor device comprise first conductors for the provision of electrical energy for the supply to the lighting module or to the lighting unit, and one or a plurality of second conductors for the provision of a control signal e.g. of a DALI signal.

In one embodiment provision is made that the control signal provided on the conductor device can be interpreted by the coupling unit or by the indirect lighting module which is contacted with the coupling unit by means of the contacting section.

In one embodiment, the rail is designed as a low-voltage rail.

In particular, the conductor device can be designed to provide electrical energy at a direct voltage of less than 60 volts, e.g. about 48 volts.

In one development, the coupling unit can be designed as a connecting unit. The connecting unit can be arranged e.g. to relay electric current, and in particular also the control signal, from the conductor device to the indirect lighting module, in particular to relay it in a substantially unchanged form. This can be advantageous e.g. if the electrical energy provided by the conductor device, e.g. in the case of direct voltage selected as the low voltage, can be used, without further conversion, for the operation of the indirect lighting module. In addition, the above-mentioned embodiment can furthermore be used e.g. when the indirect lighting module can directly use or interpret the control signal present at the conductor device.

In another embodiment, the rail is designed as a high-voltage rail, in particular a mains voltage rail.

In particular, the conductor device can be designed to provide electrical energy at a mains power alternating voltage, in particular a nominal electric voltage of about 220 to about 240 volts, e.g. 230 volts.

In one development, the coupling unit can be designed as an adapter unit which can comprise e.g. a converter. Therefore the coupling unit can additionally render possible a conversion of the electrical energy provided on the conductor device, such as a change in the type of current and/or the nominal voltage.

In particular, the adapter unit can comprise electronic devices for processing and/or interpreting the control signal received by the conductor device.

In one development, the indirect lighting module can be operated by means of electrical energy at a first electric voltage, the conductor device is provided in the inner region for the provision of the electrical energy at a second electric voltage which is higher than the first electric voltage, and the coupling unit designed as an adapter unit is arranged to receive electrical energy from the conductor device in the inner region and to provide the electrical energy for the supply to the indirect lighting module at the first electric voltage.

In a further embodiment, the rail can be provided for suspended attachment thereof, in particular from a ceiling or another part of a building or on another construction. The easily-produced electrical coupling of the indirect lighting module can in this case contribute to the simplification of work which is to be carried out during installation e.g. above head height.

In one development, the indirect lighting module can be inserted into an accommodating region of the rail, which is formed in a cross-sectional profile of the rail facing away from the inner region. In this case, the indirect lighting module can be arranged on the rail in a simple, reliable, precise and aesthetically acceptable manner in order to achieve the indirect lighting, in particular upwards towards a ceiling of a room.

In one embodiment, the accommodating region is a rear region of the rail when the lighting arrangement is in the usage state, wherein the rear region and the inner region are formed next to each other and delimited with respect to each other by the web.

In particular, the indirect lighting module can be coupled to the rail mechanically in such a way that the indirect lighting module, when in the state coupled to the rail, can be displaced relative thereto in the longitudinal direction. In this way, a position adaptation is still possible when the indirect lighting module is arranged on the rail. For example, for mechanical coupling of the indirect lighting module to the rail, the indirect lighting module and/or the rail can comprise means which render it possible to clip or latch the indirect lighting module into the rail. Such a mechanical coupling can be implemented in a relatively easy manner.

In one embodiment, the indirect lighting module is arranged to be electrically coupled to at least one extension indirect lighting module in such a way that the extension indirect lighting module can be supplied with electrical energy by the indirect lighting module through the coupling unit.

In one development, the indirect lighting module is arranged to be coupled to the extension indirect lighting module in such a way that the extension indirect lighting module can be controlled via the indirect lighting module corresponding to those control signals by means of which the control of the indirect lighting module is effected.

In particular, provision can be made that the extension indirect lighting module can be controlled by means of a signal which can be provided by means of interpretation of the control signal, provided to the conductor device, by the coupling unit or by the indirect lighting module, and can be relayed by the indirect lighting module to the extension indirect lighting module.

Furthermore, in further embodiments, more than one extension indirect lighting module can be coupled to the indirect lighting module.

The provision of one or more extension indirect lighting modules therefore renders possible the provision of elongated indirect lighting, e.g. of an indirect light strip, of greater length on one rail, wherein, at the same time, a dedicated coupling unit is not required for each module of the indirect lighting. Instead of this, the energy supply and preferably control of indirect and extension indirect lighting modules electrically coupled to one another and in series with one another takes place via a common coupling unit. This can help to save costs and installation outlay.

For example, the coupled indirect and extension indirect lighting modules can be controlled together via a common address e.g. by means of the DALI protocol.

In one embodiment, the lighting module or the lighting unit, which can be provided in addition to the indirect lighting module and can be accommodated by the rail and/or can be coupled to the rail, is provided for the provision of direct lighting. By means of the lighting arrangement, direct and indirect lighting effects can therefore be combined.

The above embodiments and developments can be combined with each other in any manner if it is useful to do so. Further possible embodiments, developments and implementations of the invention also comprise non-explicitly-mentioned combinations of features of the invention which have been described or will be described hereinafter with reference to the exemplified embodiments. In particular, in this regard a person skilled in the art will also add individual aspects as improvements or complements to the respective basic form of the present invention.

Furthermore, it should be noted that the embodiments and developments described above in connection with the lighting arrangement can likewise be applied to the coupling unit in accordance with the invention, and vice-versa.

CONTENT OF THE DRAWINGS

The invention will be explained in more detail hereinafter with the aid of the exemplified embodiments shown in the schematic figures of the drawings. In the drawing.

Figure 1:
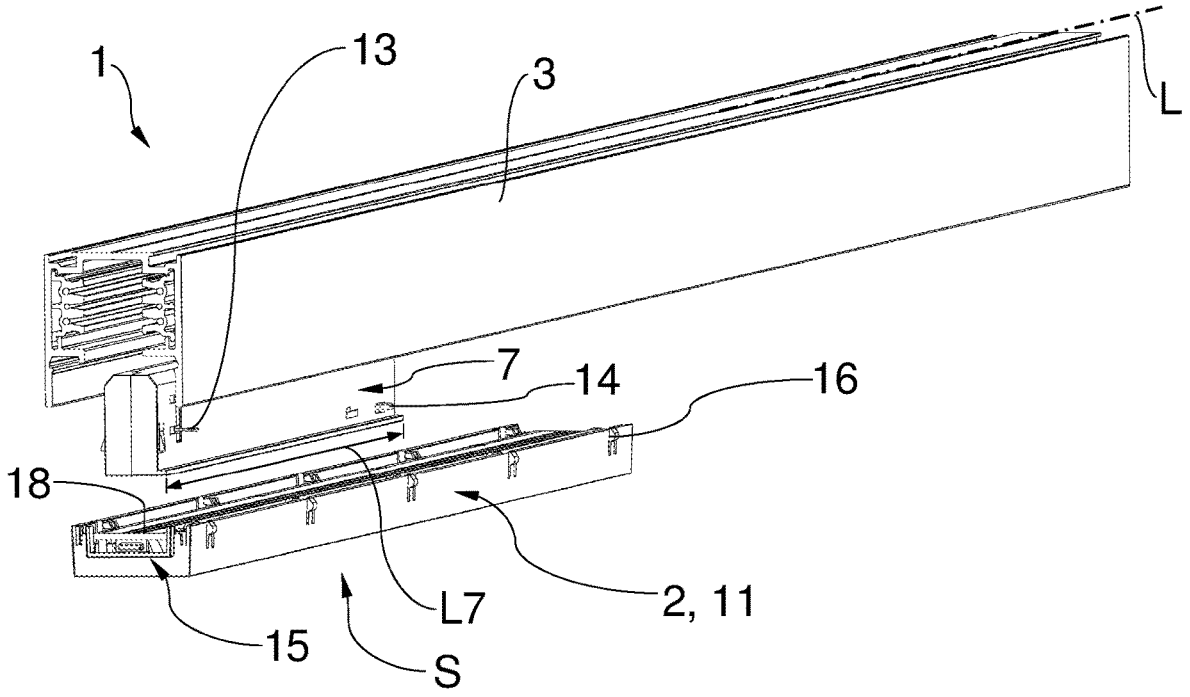
FIG. 1 shows a perspective exploded view of a lighting arrangement.

The attached drawings are intended to provide improved understanding of the embodiments of the invention. They illustrate embodiments and are used in conjunction with the description to explain principles and concepts of the invention. Other embodiments and many of said advantages will be apparent in view of the drawings. The elements in the drawings are not necessarily illustrated to scale with respect to each other.

In the figures, like and functionally identical elements, features and components and elements, features and components acting in an identical manner are provided with the same reference signs, unless indicated otherwise.

DESCRIPTION OF EXEMPLIFIED EMBODIMENTS

Figure 2:
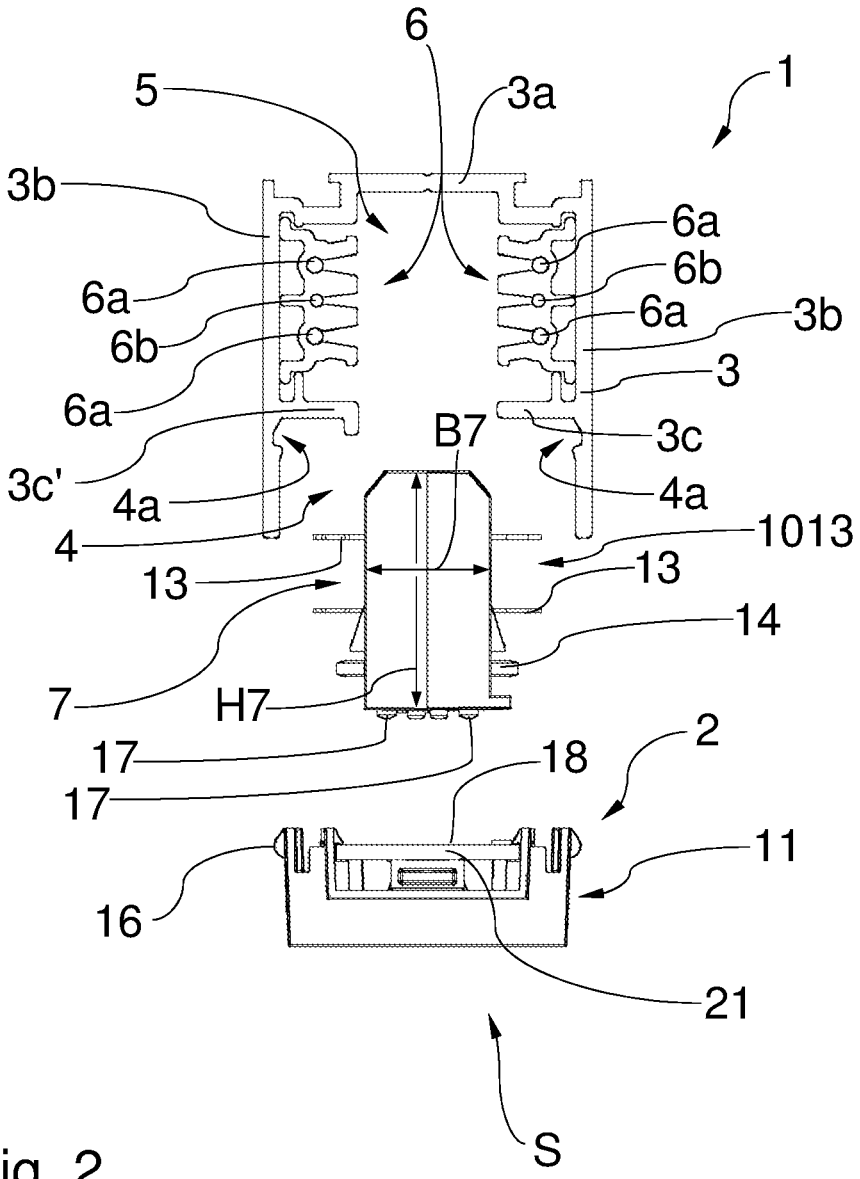
FIG. 2 shows an exploded view of the arrangement of FIG. 1 from the end face thereof.

FIGS. 1 and 2 show a first lighting arrangement 1. The lighting arrangement 1 is formed having components which are part of a modular rail lighting system. The rail lighting system is designed in such a way that optionally linear lighting modules and/or low-voltage rails and/or spotlights can be accommodated and combined in a rail. Further lighting units can be coupled to the low-voltage rails, which, like the linear lighting modules and spotlights, are preferably used for direct lighting. In addition, the rail lighting system includes the possibility of providing indirect lighting by means of one or more indirect lighting modules in some variants. Advantageously, in this case, not every single insertable illuminating component has to be equipped with a dedicated converter.

It should be mentioned that the rail can be designed for installation in a ceiling, mounting on a ceiling and/or suspension from the ceiling of a room or from another construction.

Firstly, a lighting arrangement 1 with direct lighting by means of a linear lighting module 11 will be described. The arrangement 1 has a rail 3 which is open towards the visible side S, in a finished mounted position in particular on the lower side, and has a first inner region 4 as well as a second inner region 5 located in the rail 3 above the first region 4 and arranged further towards a rear side of the rail 3 facing away from the visible side S.

On the rear side, in the finished mounted position, in particular in an upper region of the rail 3, the second region 5 is closed off by a web 3*a*, from the opposite ends of which flanges or side walls 3*b* of the rail 3, also referred to as a profile or rail profile, extend.

Inner longitudinal ribs 3*c*, 3*c*' of the rail 3 delimit the regions 4, 5 from one another, wherein an intermediate space between the longitudinal ribs 3*c*, 3*c*' provides access to the second region 5 from the first region 4.

Except for end sections of the longitudinal ribs 3*c*, 3*c*', the rail 3 is symmetrical in cross-section in relation to a longitudinal centre plane of the rail 3.

In the second region 5, conductor rails each with three poles or conductors are arranged on both sides along the rail 3 and parallel to the longitudinal direction L thereof and form a conductor device 6 with a total of six conductors 6*a*, 6*b*, wherein, of these, four conductors 6*a* are provided for the provision of electrical energy and two mutually opposing conductors 6*b* are provided for the provision of control signals.

Three of the conductors 6*a* are preferably each designed as phase conductors to provide three different electrical phases and a fourth one of the conductors 6*a* is designed as a neutral conductor.

Figure 25:
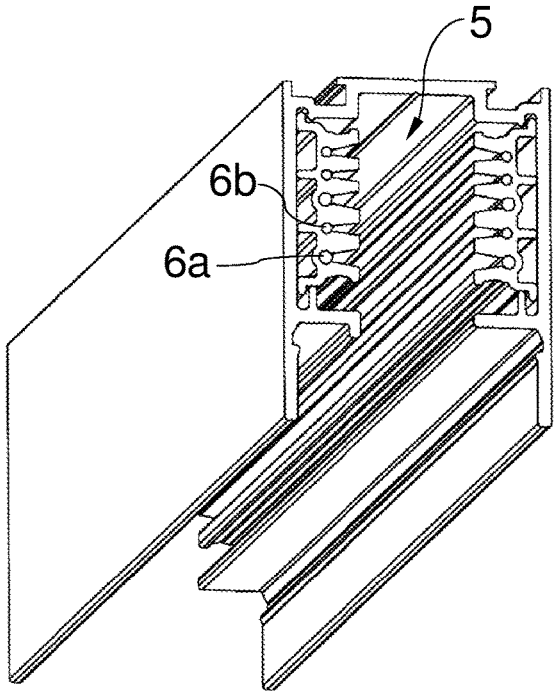
FIG. 25 shows an alternative rail.

In one variant, see FIG. 25, the conductor device 6 could alternatively provide in each case e.g. five poles or conductors 6*a*, 6*b* on both sides of the second region 5 and thus a total of ten conductors 6*a*, 6*b*, in order to be able to additionally switch emergency lights into a separate phase. FIG. 25 illustrates a rail with an alternative conductor device of this type. Again, two conductor rails, and a total of at least two conductors 6*b* for control signals, are provided in the region 5.

For example, a DALI-signal for control purposes is provided by means of the conductors 6*b*. However, a control signal based on other control or dimming methods is likewise feasible.

In FIGS. 1 and 2, the conductors 6*a* are thus provided for supplying illuminating components with electrical energy and are supplied with electrical current, preferably alternating current at mains voltage, such as 220-240V, for instance 230V, and a mains frequency of e.g. 50 Hz, by a feed unit which is not shown in greater detail. This will be referred to hereinafter by the term "high voltage".

In the rail lighting system and in the arrangement 1, illuminating components are provided which are operated with electrical energy at a substantially lower voltage, for instance at a direct voltage lower than 60V, e.g. 48V. This will be referred to hereinafter as "low voltage".

The second region 5 of the rail 3, which is formed as an upper interior space, is designed to accommodate an adapter unit 7, wherein the adapter unit 7 has a converter which converts the high voltage of the conductors 6*a* into low voltage for supplying the illuminating components, in FIGS. 1, 2 the lighting module 11, and in this case provides the type of current required by the illuminating components at the low voltage. The converter is arranged within the adapter unit 7.

Preferably, the adapter unit 7 further comprises a device, not shown in greater detail in the figures, which renders it possible to select the electrical phase of the electrical phases provided by conductors 6*a* to be used and to couple the lighting module 11, also referred to as a lighting unit, to the selected phase for power supply with interpositioning of the converter.

In the installed state, the adapter unit 7 is accommodated for the most part within the second region 5 and has substantially the basic shape of an elongate cuboid with bevelled longitudinal edges on the side thereof facing the web 3*a* in the installed state. In this case, the adapter unit 7 is thin and space-saving in design. For example, see FIG. 2, a height H7 of the adapter unit 7 can be approximately H7=28 mm and a width B7 of the adapter unit 7 can be approximately B7=14 mm. In particular, the ratio H7/B7 is thus approximately 2. A length of the adapter unit 7, see FIG. 1, can be approximately L7=300 mm. In variants, deviations from these values for H7, B7 and/or L7 are possible, e.g. H7, B7 and/or L7 could each deviate by 2 mm upwards or downwards from said values.

Figure 4:
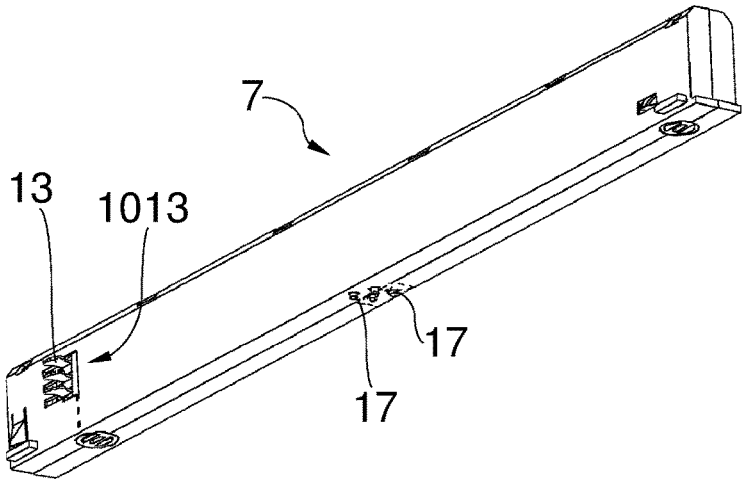
FIG. 4 shows an adapter unit of the lighting arrangement of FIG. 3 in an enlarged view.

In the region of longitudinal side surfaces of the adapter unit 7, said adapter unit has a first contact device 1013 with contact elements 13 which can be extended or folded out of the outer surface of the adapter unit 7 in order to make electrically conductive contact with one of the conductors 6*a* in each case. Contact elements 13 can also be provided for picking up the control signal, e.g. as indicated in FIG. 4 as two middle contact elements 13 of a movable arrangement of six contact elements 13, of which three can each protrude from one of the two longitudinal sides of the adapter unit 7. In this way, the adapter unit 7 can be electrically coupled to the conductor device 6 in order to receive electrical energy as well as control signals from the conductor device 6. The contact elements 13 can be folded out or in by a mechanism which can be actuated by a fitter or operator. In particular, in the case of a ten-pole rail, such as in FIG. 25, the contact device 1013 is not necessarily provided with contact elements 13 for contacting each of the ten conductors 6*a*, 6*b*, but nevertheless can be provided with e.g. four or six contact elements 13.

The adapter unit 7 of FIGS. 1, 2 can be placed freely in the inner region 5 substantially at any point along the rail 3. In addition, the adapter unit 7 inserted into the region 5 can be displaced in the longitudinal direction L when the contact elements 13 are folded in and do not contact the conductors 6*a*, 6*b*.

Furthermore, mechanical engagement elements 14 are provided in the region of the two longitudinal side surfaces of the adapter unit 7, which can also be extended or folded out from the outer surface in order to releasably mechanically secure the adapter unit 7 by engaging behind the inner longitudinal ribs 3*c*, 3*c*' of the rail 3. In addition, further engagement elements can be provided e.g. in the form of latches or clips, which enable temporary, releasable fixing to facilitate mounting.

In FIGS. 1, 2, the second region 5 is defined towards the first region 4 by the inner longitudinal ribs 3*c*, 3*c*' of the rail 3. These ribs 3*c*, 3*c*' form a type of two-part intermediate wall, in the centre region of which an intermediate space remains along the entire length of the rail profile 3 as a passage for introducing the adapter unit 7. In FIGS. 1, 2, the flanges or side walls 3*b* of the rail 3 extend downwards beyond the ribs 3*c*, 3*c*', whereby the first region 4 is formed.

The adapter unit 7 in FIGS. 1, 2 has, one the side facing the visible side S in the installed state, in the figures on the underside, punctiform contact elements 17, some of which serve a "current collectors" for establishing the electrical supply to the lighting module 11, wherein in some variants one or more others of the contact elements 17 can serve to transmit signals for control purposes. Punctiform contact elements 17 may have a pin-like or pin-head-like shape.

For the lighting arrangement 1 of FIGS. 1, 2, a lighting assembly 2 is illustrated as the illuminating component and is designed as the linear lighting module 11 for direct lighting.

The lighting module 11 also has a double-sided printed circuit board ("PCB") 21 on the upper side thereof in the installed state, on the main surface of which facing outwards strip-like contact elements 18 are formed as tracks and serve for electrical coupling to the adapter unit 7 via the contact elements 17 for the purpose of supplying energy and for control purposes. Arranged on the other main surface of the printed circuit board 21 are light-generating devices which are designed as LEDs. Further electrical and/or electronic devices for operating the LEDs, as well as tracks can likewise be arranged on the printed circuit board 21.

When assembling the lighting arrangement 1, the adapter unit 7 is initially introduced from below into the second region 5, is electrically coupled to the conductor device 6 by means of the contact elements 13 e.g. with rotation of an actuating element, and e.g. is additionally secured mechanically by means of the elements 14. Then, the lighting module 11 is inserted from below into the first region 4 below the adapter unit 7 and latched or clipped in longitudinal grooves 4*a* behind further longitudinal ribs of the rail 3 with the aid of latch or clip devices 16.

The latch devices 16 in addition to corresponding longitudinal ribs and longitudinal grooves 4*a* are designed in such a way that the assembly 2 can be clipped/latched into the region 4 with only a relatively small force, and likewise can be withdrawn from the rail 3 from below. In this case fixing of the lighting module 11 in the longitudinal direction L is not provided in the arrangement 1. This and the suitable force effect of the latching/clipping devices 16 allow the lighting module 11 to be displaced longitudinally in the longitudinal direction L, whereby position adjustments are possible.

The reception of current by the lighting module 11 is rendered possible by means of a number of the tracks 18 which are attached to the printed circuit board 21 and which come into electrically conductive contact with in each case an allocated one of the punctiform contact elements 17. In this case, the strip-like contact elements 18 are provided on a side of the assembly 2 facing the adapter unit 7, and extend in the longitudinal direction L of the rail 3 when the assembly 2 is inserted into the first, lower region 4.

The lighting module 11 can still be displaced within the rail 3 in the longitudinal direction L even after the electrical coupling, and at the same time a power supply is ensured as long as the printed circuit board 21 is located at any position under the contact elements 17 of the adapter unit 7.

The control signal, e.g. a DALI signal or a control signal based on another protocol, is taken from the conductor device by the adapter unit 7, and the lighting module 11 is operated on the basis of this control signal. In the case of the arrangement 1, the control signal can be interpreted by devices in the adapter unit 7, an output signal for actuating the lighting module 11 can be generated and the output signal can be transmitted to the lighting module 11 via one or more of the contact elements 17. Alternatively, provision can be made that the control signal received from the conductor device 6 is relayed by the adapter unit 7 via one or more of the contact elements 17 to the lighting module 11 and is interpreted by devices in the lighting module 11.

The rail 3 can be formed with a plurality of rail sections which are connected to one another to form a longer linear or angled system of selectable length which can accommodate a multiplicity of illuminating components of the same or different type. If the rail 3 is constructed having a plurality of sections joined together, each with conductor rail sections arranged therein to form the conductor device 6, the conductor rail sections forming the conductor device 6 can be electrically connected in the second region 5, i.e. in the high-voltage region, to intermediate or connecting pieces (not illustrated in the figures) for electrically coupling the corresponding conductors 6*a*, 6*b*.

Figure 3:
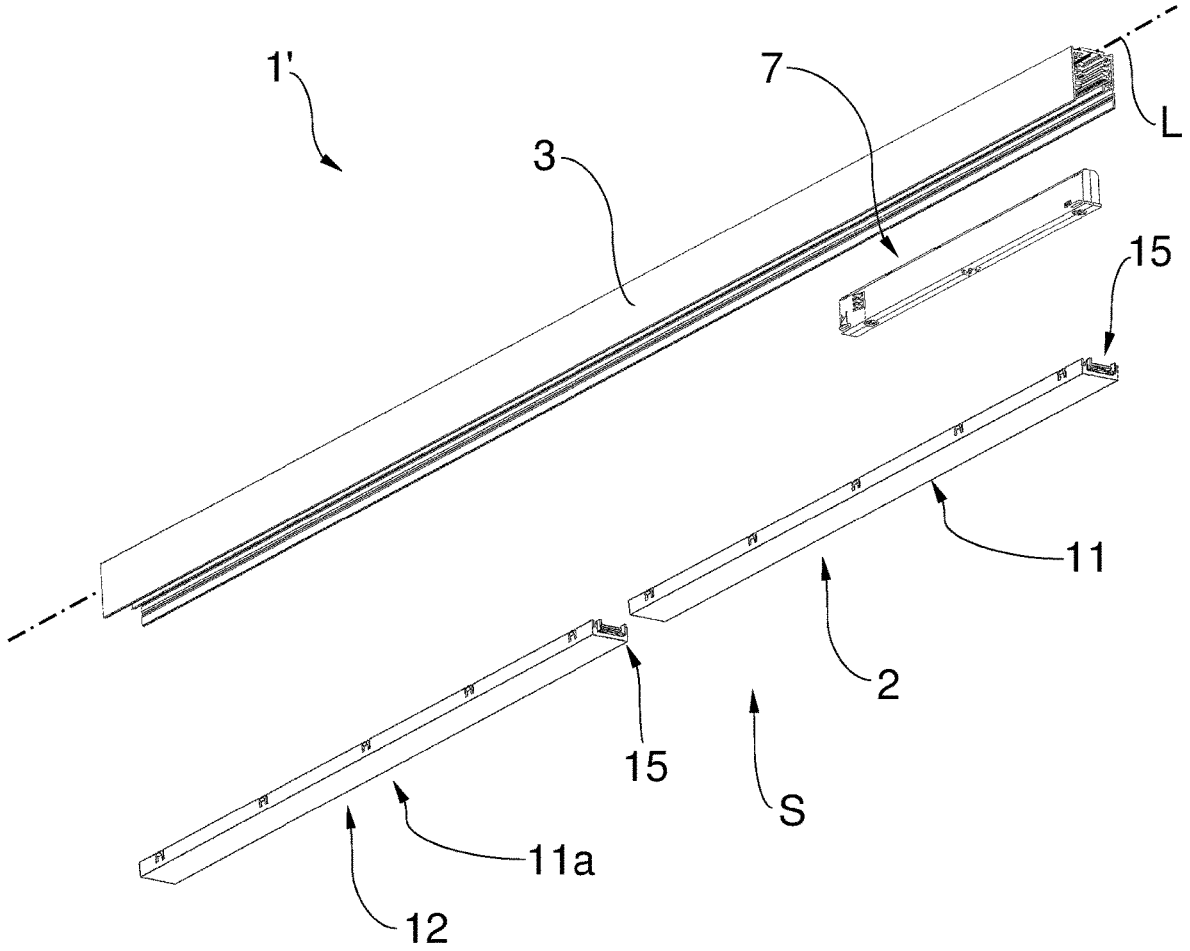
FIG. 3 shows a variant of the lighting arrangement of FIG. 1 in a perspective exploded view from the visible side.

For example, see FIG. 3, in the case of a lighting arrangement 1', a first assembly 2 designed as a linear lighting module 11 and one or more further assembly(ies) 12, each likewise designed as a linear lighting module 11*a*, of which only one is illustrated in FIG. 3, can be provided.

The end faces of the assemblies 2, 12 are each equipped with connecting devices 15 provided for this purpose in such a way that the assembly 2 can be electrically coupled in each case to one of the further assemblies 12 at both end-face ends thereof. In this manner, the assembly 2 and, thereby, the assembly(ies) 12 are supplied with electrical energy provided by the adapter unit 7, in particular with direct current at low voltage.

Therefore, in the case of a longer lighting arrangement 1', not each section of the rail 3 and not each lighting module 11, 11*a* requires a separate adapter unit in the upper (high-voltage) rail profile inner region 5. In FIG. 3, further lighting modules 11, 11*a*, e.g. a total of three modules, can be supplied by a common adapter unit 7.

In addition, the assemblies 2, 12 are controlled and operated according to a master-slave principle. In this case, the assembly 2 directly coupled to the adapter component 7 is considered to be the "master", to which the further assembly(ies) 12 indirectly coupled to the adapter unit 7 via the assembly 2 and the devices 15 are subordinated as "slave". The interpretation of the control signal applied to the conductors 6*b*, for instance as a DALI signal, can be carried out by the adapter unit 7 or the first assembly 2 ("master"), wherein an output signal generated on the basis of the control signal from the adapter unit 7 or the assembly 2 is passed to the "slave" assembly(ies) 12 via the device 15. In both cases, the assemblies 2 and 12, i.e. the lighting modules 11 and 11*a*, are activated via a common address, e.g. a common DALI address, this address is thus allocated to the adapter 7 or the module 11 and indirectly to the coupled modules 11*a*. The extension lighting module 11*a* receives power and control signals corresponding to the first module 11.

At the same time, the installed assemblies 2, 12 can be displaced together along the rail 3. In an advantageous manner, the adapter component 7 does not have to be released and repositioned in the inner region 5, configured as a high-voltage region, for this purpose.

The lighting module 11*a* of FIG. 3 is similar to the lighting module 11, wherein the printed circuit boards of the second and further lighting modules 11*a* are not necessarily double-sided but rather can be made single-sided and therefore less expensively. The printed circuit board in the lighting module(s) 11*a* can render possible the supply of power to, and operation of, the LEDs on the inwardly directed main surface of the printed circuit board, and the supply of power and signals via the device(s) 15.

In particular, the modules 11, 11*a*, which are supplied together—directly ("master") or indirectly ("slave")—by an adapter 7, are switched in the same electrical phase selected by means of the adapter unit 7 and are supplied thereby.

Figure 5:
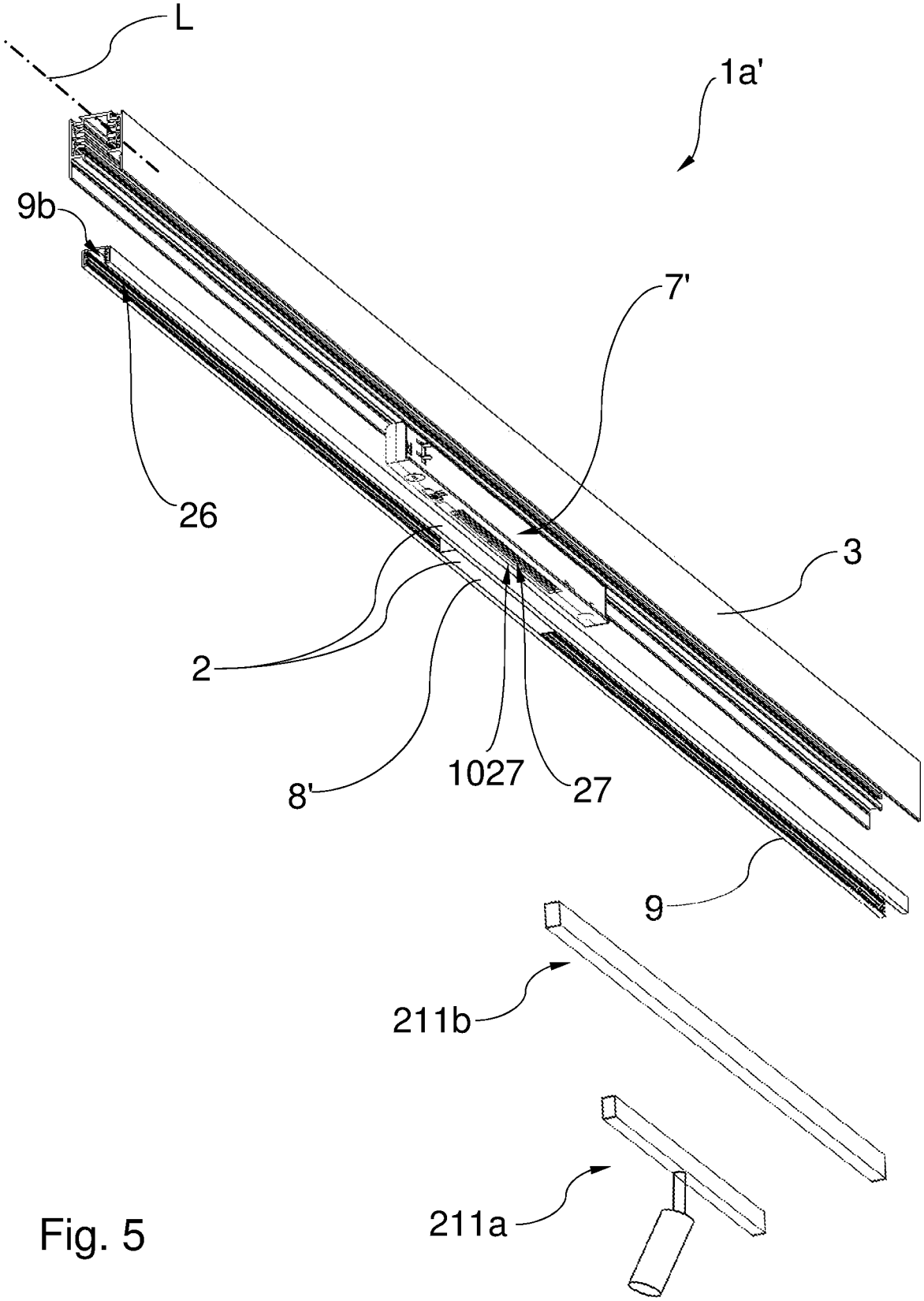
FIG. 5 shows a lighting arrangement with a coupling unit according to one exemplified embodiment, in a perspective first exploded view from a visible side.

FIGS. 5-13 show a lighting arrangement 1*a*, 1*a*' and variants thereof. The arrangement 1*a*' of FIG. 5 comprises a rail 3 corresponding to that of FIGS. 1-3. Lighting units 211*a* and/or 211*b* drawn by way of example in FIG. 5 are coupled to the rail 3 by means of an assembly 2 with a smaller rail 9.

The second, smaller rail profile 9 is accommodated in the first region 4. The second, smaller rail 9 is supplied with low voltage by an adapter unit 7' therebehind in the installed and operational position, and is designed to at least partially accommodate lighting units 211*a*, 211*b*-illustrated only schematically—and for coupling thereto. Furthermore, the rail 9 enables the supply of power to the lighting units 211*a*, 211*b*, moreover the rail 9 can provide control signals for the lighting units 211*a*, 211*b*, wherein the lighting units 211*a*, 211*b* are equipped e.g. with suitable devices for electrical coupling, and e.g. furthermore for mechanical coupling, to the rail 9. The lighting units 211*a*, 211*b* are preferably displaceably coupled to the rail 9 and are provided in particular for direct lighting.

Furthermore, according to one exemplified embodiment, the lighting arrangement 1*a*' comprises a coupling unit 8', which is also designated hereinunder as connecting unit 8', and which renders possible electrical coupling of the rail 9 and the adapter unit 7'. The assembly 2 which can be accommodated in the first region 4 of the rail 3 is formed in this case with the rail 9 and the connecting unit 8'. Provision is preferably made that the assembly 2, in particular the rail 9, can be latched to the rail 3 for mechanical fastening or can be clipped into the rail 3, for which purpose suitably designed means not illustrated in greater detail in the figures can be provided. The mechanical fastening of the assembly 2 formed with the rail 9 and the connecting unit 8' is configured similarly to the latching or clipping-in of the assembly 2 in the case of the arrangements 1, 1' such that a displacement of the rail 9 and the connecting unit 8' in the longitudinal direction L of the rail profile 3 is possible even after the latching or clipping-in. Also in the arrangement 1*a*', the latching of the assembly 2 with the rail 3, and the release from this latching, requires relatively little force, whereby the latching and release can be performed easily and quickly.

The adapter unit 7' is constructed in the same way as the adapter unit 7 with regard to its basic shape and dimensions, mechanical fixing in the outer rail 3 and electrical coupling to the conductor device 6, and so reference is made to the above explanations in this respect. A converter is arranged in the interior of the adapter unit 7'.

In contrast to the adapter unit 7, the lower side of the adapter unit 7', which in the mounted state faces the visible side S, is not equipped with punctiform current collectors for supplying lighting modules. Instead of this, the adapter unit 7' of FIGS. 5-13, on the underside of the adapter unit 7', i.e. the side facing the rail 9, when the adapter unit 7' and the assembly 2 comprising the rail 9 and the connecting unit 8' are inserted in the rail 3, comprises a contact device 1027 with a plurality of strip-like contact elements 27. The contact elements 27 can each be brought into electrically conductive contact with an allocated contact element 28 of the assembly 2 when the assembly 2 is inserted into the rail 3. When the adapter component 7' is inserted into the second region 5, the strip-like contact elements 27 extend with the longitudinal direction thereof in parallel with the longitudinal direction L of the rail 3.

The first low-voltage rail module, which can be inserted under the adapter unit 7' into the illustrated section of the rail profile 3 and forms the assembly 2, has a passage-opening 10' on an upper side of the rail 9 in the assembled state, wherein the passage-opening 10' is incorporated into a web 9*a* of the rail 9. After inserting the adapter unit 7' and the assembly 2 into the rail 3, the web 9*a* faces the adapter unit 7'.

Figure 6:
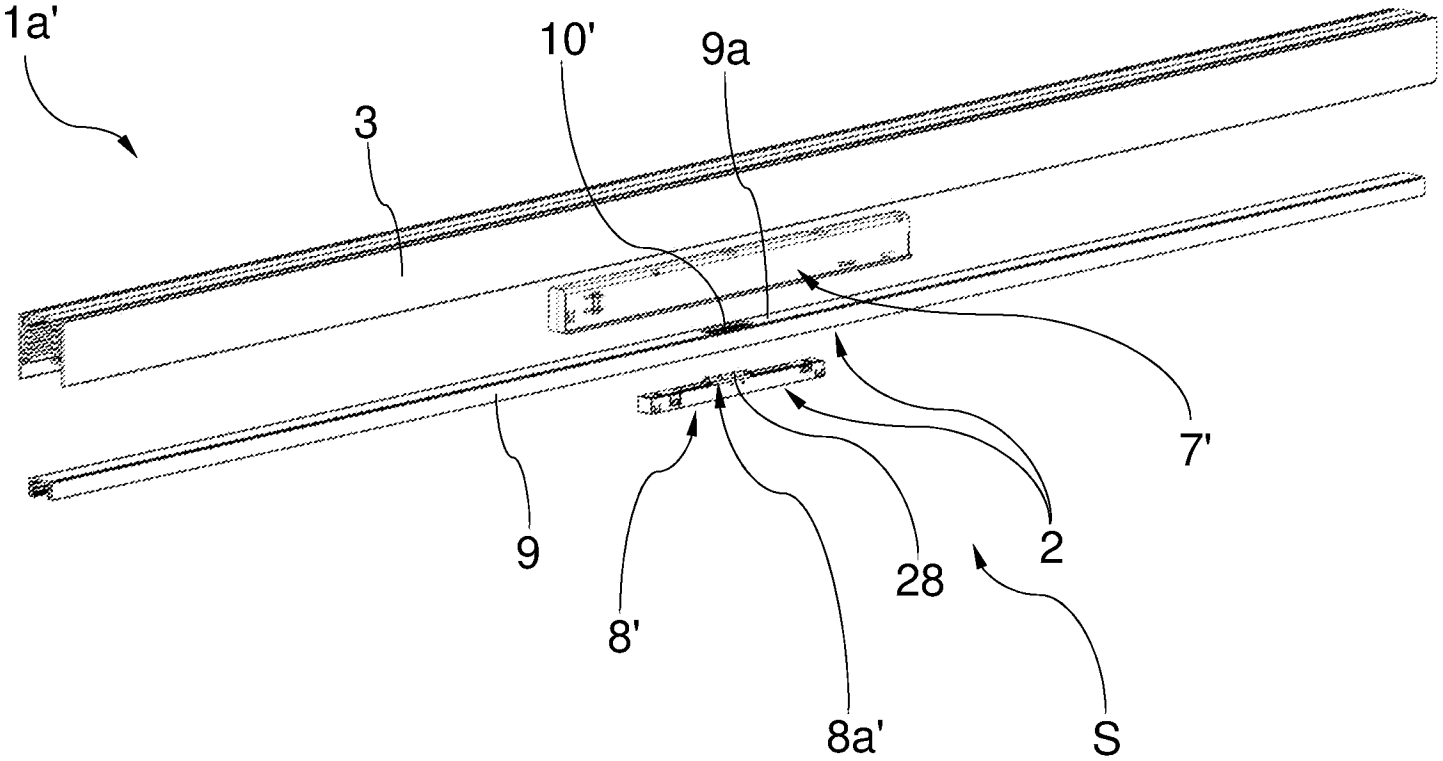
FIG. 6 shows the lighting arrangement according to FIG. 5 in a perspective second exploded view.
Figure 7:
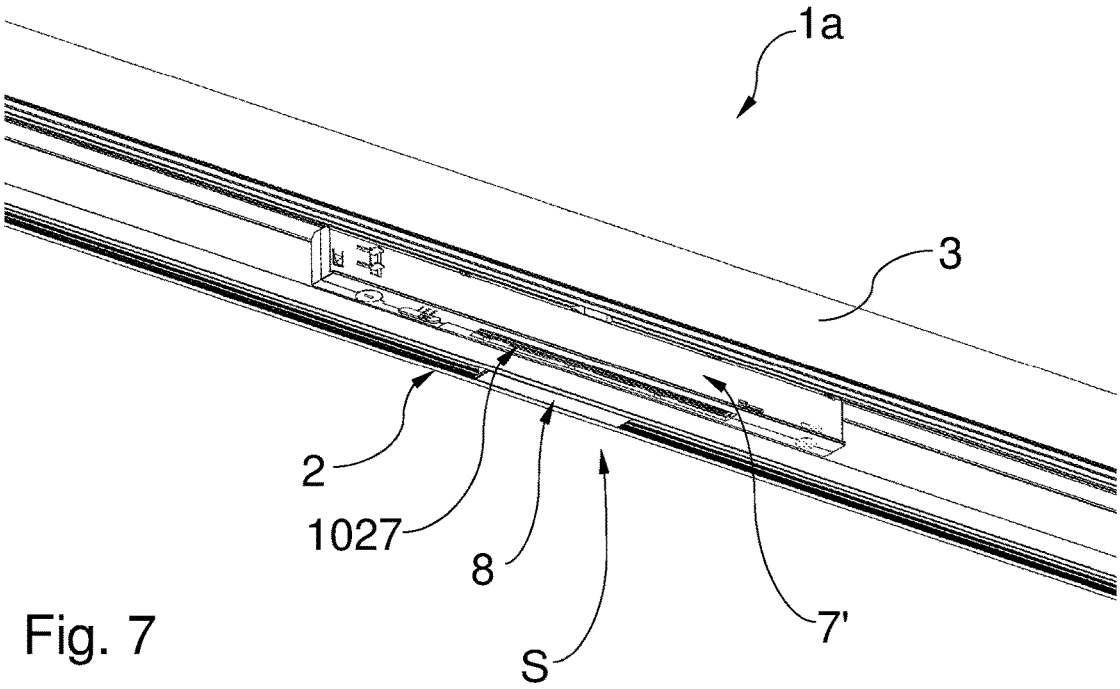
FIG. 7 shows a lighting arrangement according to one variant of the arrangement of FIGS. 5-6 with a coupling unit according to another exemplified embodiment, in a perspective first exploded view from a visible side.
Figure 8:
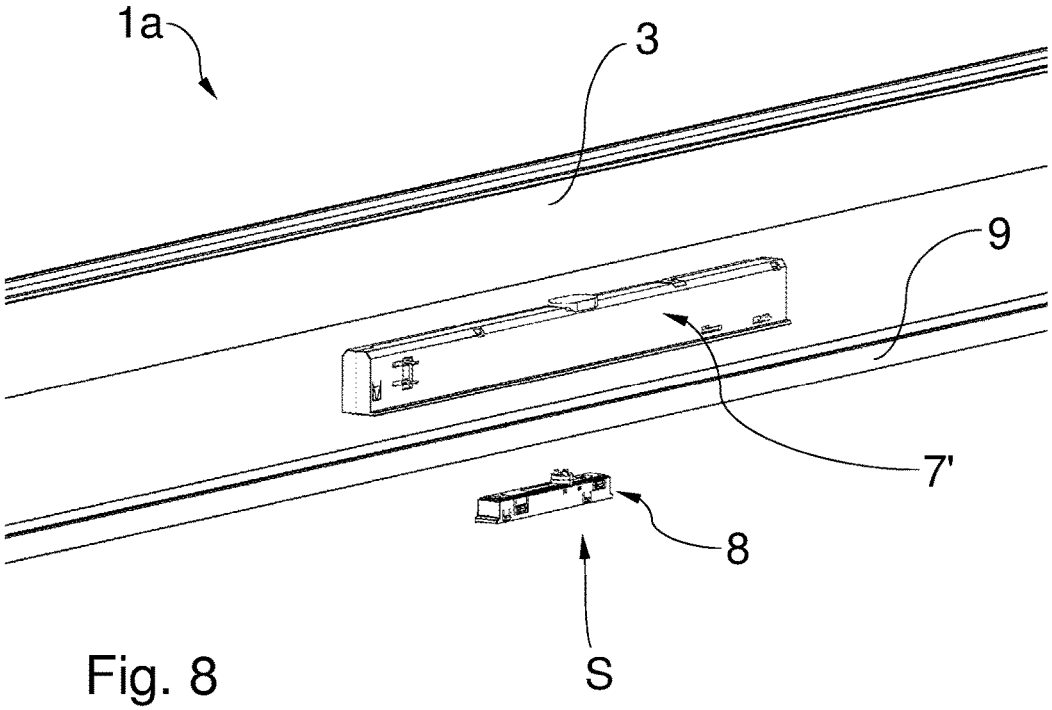
FIG. 8 shows the lighting arrangement of FIG. 7 in a perspective second exploded view.

A contact device of the connecting unit 8' is formed with the contact elements 28. The plurality of contact elements 28 of FIGS. 5, 6 are arranged on a projection-like contacting section 8*a'* of the connecting unit 8' and designed as punctiform, pin-like or pin-head-like contact elements 28 on the upper side of the contacting section 8*a'*.

By introducing the contacting section 8*a'* into the passage-opening 10', the punctiform contacts 28 of the connecting unit 8' can each be brought into electrical connection to one of the tracks 27 of the adapter 7' mounted thereabove, in order to electrically couple the assembly 2 to the adapter unit 7'.

Figure 9:
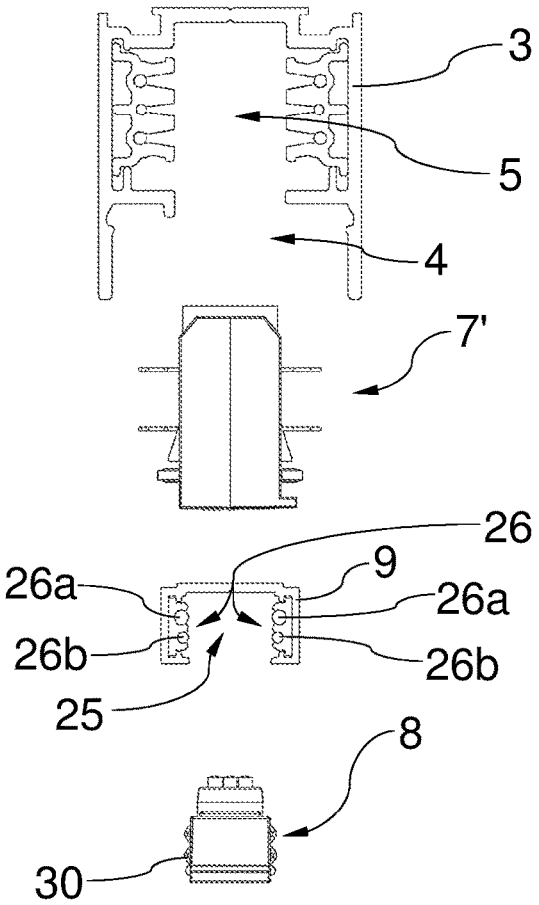
FIGS. 9-11 show some steps when assembling a lighting arrangement according to the exemplified embodiment of FIG. 7 in an end-face view.

The connector 8' serves as a coupling unit and consequently ensures the supply to the assembly 2 designed as a low-voltage rail module. In this case, the rail 9 is equipped with a conductor device 26 comprising low-voltage conductors 26*a* and control signal conductors 26*b* in the longitudinal direction of the rail 9. A cross-section of the rail 9 is shown in FIG. 9 and is also provided in this form and configuration in the variant of FIGS. 5, 6.

The low-voltage rail modules 2 are thus equipped to accommodate and supply power to the lighting units 211*a*, 211*b* to be operated at low voltage, as well as to supply control signals to the lighting units 211*a*, 211*b* on the rail 9.

In particular, provision is made that the conductors 26*a* of the conductor device 26 in the inner region of the rail 9 are supplied with electrical energy at low voltage, e.g. a direct voltage of 48V, and with one or more control signals, e.g. a DALI signal, via the adapter unit 7' and the connecting unit 8'.

The provision of the electric current at low voltage by means of the adapter unit 7', starting from the provision of mains voltage via the conductor device 6, is effected by means of a converter of the adapter unit 7', as described above for the arrangements 1, 1'. The low voltage for the supply of energy to the lighting units 211*a*, 211*b* is then relayed to the connecting unit 8' via e.g. two of the contact elements 27, 28 in each case. It is also possible to select an electrical phase with the aid of the adapter unit 7', as described above.

Control signals, for instance a DALI signal, provided at the conductors 6*b* of the conductor device 6 are relayed in the arrangement 1*a'* in unchanged form to the connecting unit 8' via one or more further corresponding ones of the contact elements 27, 28.

For example, on both sides of the inner region 9*b* of the rail 9, one conductor 26*a* per side can be provided for the power supply and another conductor 26*a* can be provided for the control. The lighting units 211*a*, 211*b* which can be used there can be addressed in particular separately with control signals, for instance via dedicated, separate DALI addresses.

The connecting unit 8' is configured to receive the electrical energy and control signals from the adapter unit 7', and to feed the electrical energy received via contact elements 27, 28 into the conductors 26*a* of the conductor device 26 of the rail 9, as well as the control signals relayed by the adapter unit 7' via the further contact elements 27, 28 into the conductors 26*b*. For this purpose, the connecting unit 8' comprises a contact device for the electric coupling to the conductor device 26. Furthermore, the connecting unit 8' can be mechanically latched or clipped to the rail 9 of the assembly 2.

Variants of the lighting arrangement 1*a'* according to further exemplified embodiments are shown in FIGS. 7-13. Apart from the differences described below, the above statements relating to FIGS. 5, 6 also apply to the lighting arrangements 1*a*, 1*a*" of FIGS. 7-13.

The lighting arrangement 1*a* of FIGS. 7-12 in turn comprises a rail 3, an adapter unit 7', and an assembly 2, wherein lighting units e.g. 211*a*, 211*b*, are coupled to the rail 3 by means of the assembly 2. With respect to the embodiment of the rail profile 3 and the adapter unit 7' and the functions thereof, reference is made to the statements above.

Figure 10:
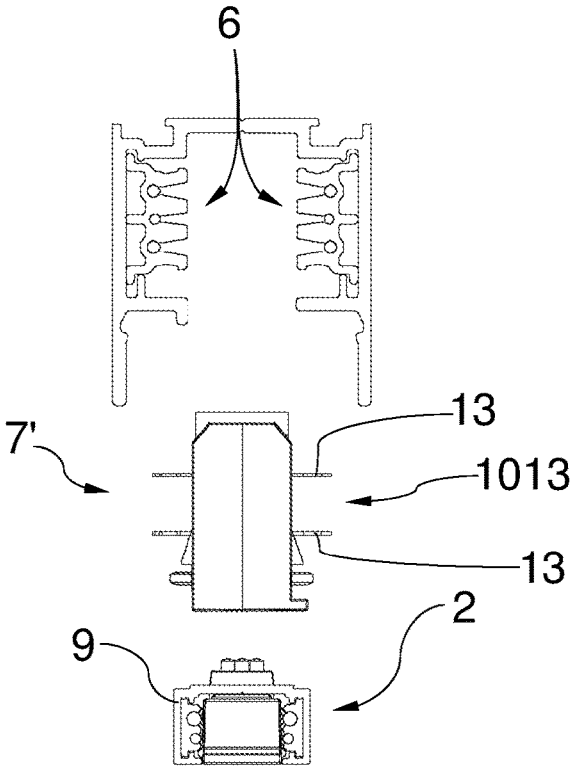
Figure 11:
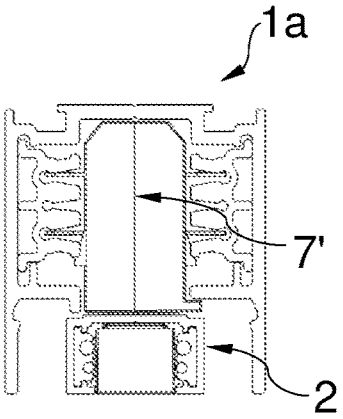
Figure 12:
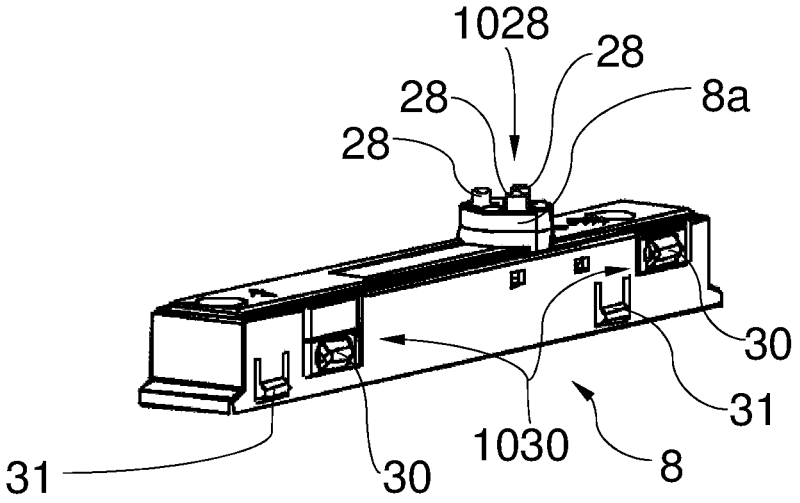
FIG. 12 shows a coupling unit for use in the variant of FIGS. 7-11.

In the variant of FIGS. 7-13, the assembly 2 in turn comprises a second rail 9 with a conductor device 26 which is arranged in the inner region 25 thereof and which is divided into two and arranged on both sides of the inner region 25, see FIG. 9, and a connecting unit 8, shown on a larger scale in FIG. 12.

The connecting unit 8 in FIGS. 7-13 is of an elongate, box-like external shape and designed to be arranged substantially completely within the inner region 25 of the rail 9 in such a way that the conductors 26*a* of the conductor device 26 are located laterally of the connecting unit 8, see FIGS. 9-11. A first contact device 1030 comprising contact elements 30, see FIG. 12, is configured to make electrically conductive contact with the conductors 26*a*, 26*b* of the conductor device 26 extending along the rail 9 when the connecting unit 8 is inserted into the inner region 25. Elastically resilient latching elements 31 serve to clip the connecting unit 8 into the rail 9 preferably in a releasable manner for mechanical coupling of the components 8 and 9.

In FIGS. 7-13, the connecting unit 8 likewise has the function of a coupling unit 8 which renders possible the electrical coupling of the rail 9 to the adapter unit 7' in order to transfer power and control signals. The connecting unit 8 has a contacting section 8*a* which is introduced into a passage-opening 10 in the web 3*a* of the rail 3 when the coupling unit 8 is inserted into the rail 9. A second contact device 1028 is provided on the contacting section 8*a* with—in FIG. 12 by way of example three—punctiform, pin-like or pin-head-like contact elements 28. The contact elements 28 are each designed and arranged to make electrically conductive contact with a corresponding one of the strip-shaped or web-shaped contact elements 27 of the adapter unit 7'.

In contrast to the plate-like contacting section 8*a'* in FIG. 6, in FIGS. 7-13, the contacting section 8*a* is formed with a relatively small basic surface and protrudes relatively far over the remaining surface of the connecting unit 8, e.g. is of cylinder-like shape and comprises the three contact elements 28. An outer contour of the contacting section 8*a* corresponds preferably to an inner cross-sectional shape of the passage-opening 10.

Furthermore, it should be noted that in FIGS. 7-11 and 13 the adapter unit 7' is provided approximately in the middle in relation to the longitudinal axis thereof, and, on the surface thereof facing towards the web 3*a* of the rail 3 in the mounted state, is provided with a protrusion 7*a'*. This can be part of a body and/or housing of the adapter unit 7' and in further variants can be equipped with contact elements, instead of the contact elements 27, wherein, however, in FIGS. 7-11, 13 contact elements are not present on the protrusion 7*a*'. The protrusion 7*a*' could alternatively be omitted from the adapter unit 7'.

Figure 13:
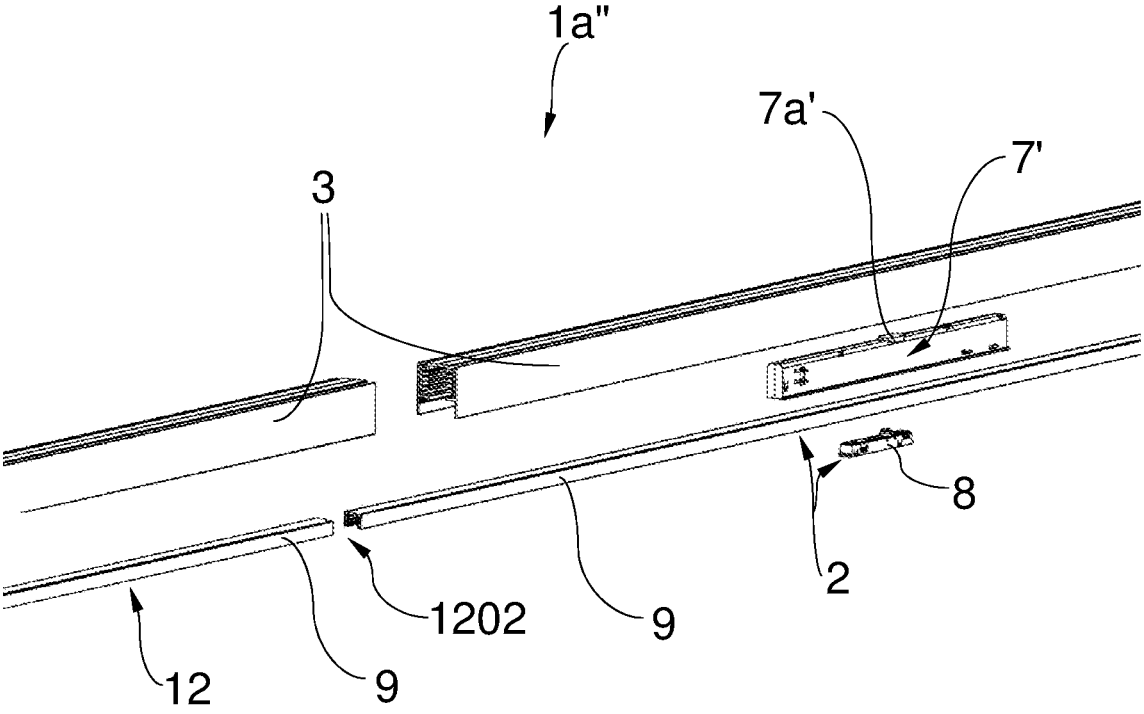
FIG. 13 shows a further variant of the arrangement of FIGS. 7-11 according to a further exemplified embodiment.

In one variant of the arrangement 1*a*, at least one further assembly 12 can be provided, which is supplied, via the assembly 2, with electrical energy and control signals, which are provided by the adapter unit 7'. Such a lighting arrangement 1*a*" is illustrated in FIG. 13. Similarly to the assembly 2, the assembly 12 in FIG. 13 has a rail 9, to which one or more lighting unit(s), e.g. 211*a*, 211*b* (not shown in FIG. 13), can be coupled and/or at least partially accommodated by the further rail 9. The extension rail 9 of the assembly 12 in FIG. 13 likewise has a conductor device 26 similar to the assembly 2 in FIGS. 5-12. In the region of a joint 1202, the assemblies 2, 12 are coupled to one another in such a manner that the corresponding conductors 26*a*, 26*b* of the two rails 9 are each in electrical contact with each other at the adjacent end-face ends thereof. For this purpose, e.g. suitable designed coupling pieces (not shown in greater detail) can be provided at the joints 1202.

In this way, a plurality of low-voltage rail modules in the form of the assemblies 2, 12 can be inserted into the rail 3 adjoining each other and can be electrically connected. The assembly 12 in FIG. 13 does not comprise a connecting unit 8 or 8'. Therefore, it is sufficient to couple only a first low-voltage rail module, i.e. the assembly 2, to the high-voltage rail 3 electrically via the adapter unit 7'. The low-voltage rail modules 2, 12 are all switched together in the same phase, which can be selected by means of the adapter unit 7'. Electric current for the supply of the lighting units 211*a*, 211*b* and control signals are relayed to the coupling point 1202 via the conductors 26*a*, 26*b*, whereby lighting units located on the extension rail 9 of the assembly 12 can be controlled individually via dedicated addresses.

It is apparent from FIG. 13 that the rail 3 can be formed with a plurality of rail profile sections connected to one another at the end face in order to create a longer linear system, such as by means of suitable connecting pieces. Not every section of the rail 3 and not every rail section 9 requires a separate adapter unit 7' in the upper region 5.

The arrangements 1*a*, 1*a*', 1*a*" each likewise render possible, after the insertion of the adapter unit 7' and the assembly 2 and, if applicable, of the assembly 12 into the rail 3, a displacement of the assembly 2 or the assemblies 2 and 12, including rails 9 and connecting unit 8 or 8', relative to the adapter unit 7'.

FIGS. 14-18 show a lighting arrangement 1*b* according to one exemplified embodiment and a variant 1*b*' thereof, which can be attached in a suspended manner and can be fitted with indirect lighting in addition to the illuminating components for producing direct lighting. The lighting arrangement 1*b*, 1*b*' of FIGS. 14-18 can be suspended e.g. from a ceiling of a room or other part of a building or from another construction. Indirect lighting is implemented in the arrangements 1*b* and 1*b*' in the manner described hereinafter.

The lighting arrangement 1*b*, 1*b*' comprises a rail 3" which, similarly to the rail profile 3 in FIGS. 1-3, 5-13, has a region 4 and an inner region 5, the configuration and function of which are described above. However, the rail profile 3" differs from the rail profile 3 in that in the case of the rail 3" an accommodating region 44 is additionally provided on a rear side facing away from the visible side S, and thus on the rear side of the web 3*a*. The accommodating region 44 is formed in the cross-sectional profile of the rail 3" as a flat channel facing away from the second region 5. The cross-sectional shape of the rail 3" is substantially symmetrical to a longitudinal centre plane, except for end sections of the longitudinal ribs 3*c*, 3*c*' which are different.

The accommodating region 44 serves to accommodate an assembly which is designed as an elongated indirect lighting module 40, which can be inserted into the accommodating region 44 and can emit light in the mounted state substantially upwards, e.g. in the direction of the ceiling of the room.

The rail 3" in FIGS. 14-18 is equipped with a three-phase, or alternatively a five-phase, conductor device 6 configured for mains voltage, similar to that described above with respect to the rails 3, 3'. The web 3*a* defines the inner region 5 equipped with the conductor device 6 at the top and thus separates the accommodating region 44 from the inner region 5. In the upwards direction, i.e. to the rear side of the rail 3" opposite to the visible side S, this is equipped with one or more passage-openings 50, see FIG. 17, in the web 3*a*.

Furthermore, an adapter unit 7" is provided which can be introduced into the rail 3" in a similar manner to the adapter units 7, 7' and which is designed in a similar manner to the adapter units 7, 7' with regard to the basic shape, mechanical fixing and electrical coupling in the region 5, wherein differences are described hereinafter.

In addition to the first contact device 1013, the adapter unit 7" has a second contact device 1017*a* with punctiform contact elements 17*a* on the top side of the adapter unit 7". In this case, the contact elements 17*a* are pin-like or pin-head-like and protrude from an upper surface of a protrusion-like contacting section 7*a*" which can be formed substantially like the protrusion 7*a*' of FIG. 13. The contacting section 7*a*" is arranged on the adapter unit 7" substantially centrally in relation to the longitudinal extension of said adapter unit and is provided on the top side of the adapter unit 7" which in the inserted state faces away from the visible side S and faces towards the web 3*a*.

The contacting section 7*a*" can be introduced into the opening for the electrical coupling of the indirect lighting module 40 and the adapter unit 7". Thus, the contact elements 17*a*, see FIG. 14, can protrude through the opening 50 and protrude upwards out of said opening. A body section of the contacting section 7*a*" preferably substantially fills the passage-opening 50, whereby said opening is closed after insertion of the adapter unit 7".

The adapter unit 7", like the adapter unit 7, 7', with selection of a suitable opening 50 or introduction of the opening 50 at the desired longitudinal position, can be positioned fundamentally freely along the rail 3", but can no longer be displaced longitudinally after insertion of the contacting section 7*a*" into the opening 50.

The first indirect lighting module 40 which can be displaceably inserted thereabove into the rail 3" has a double-sided printed circuit board 41 ("PCB") which can be electrically coupled on its underside to the protruding contact elements 17*a* of the adapter unit 7" via a contact device 1047 having web-shaped or strip-like contact elements 47. Further indirect lighting modules can each be inserted into the accommodating region 44 as an extension indirect lighting module 40*a* on the end face adjoining the first indirect lighting module 40 and can be connected to the first indirect lighting module 40 according to a master/slave principle, wherein the indirect lighting module 40 can be considered to be the "master". The connection can be established by means of connecting devices, not shown in greater detail, at a joint 4040, see FIG. 18. The further indirect lighting modules 40*a* or "slaves" can have an at least single-sided printed circuit board instead of the double-sided printed circuit board 41, which can contribute to cost savings and simplified manufacturing.

An electrical supply to the indirect lighting module 40*a* is effected via the indirect lighting module 40, wherein, e.g. as in the case of the arrangements of FIGS. 1-4, a low voltage for the operation of the indirect lighting modules 40, 40*a* is provided by the adapter unit 7" which includes a converter. The electrical phase to be used for the power supply to the indirect lighting modules 40, 40*a*, with interpositioning of the converter, and provided by the conductor device 6 can also be selected by means of the adapter unit 7", as described above.

The control of the indirect lighting modules 40, 40*a* is made possible in a similar manner as with the direct lighting modules 11, 11*a*, wherein the indirect lighting modules 40, 40*a* are addressed via a common address, e.g. a DALI address, and are controlled together. The control signal provided at the conductors 26*b* of the conductor device 6 is interpreted by devices in the adapter unit 7" or alternatively by devices on the board 41 of the "master" indirect lighting module 40 and, based thereon, an output signal is generated for the control, wherein the contact device 1017*a* is designed e.g. for communicating the output signal generated on the basis of the interpretation of the control signal in the adapter unit 7" or for relaying the control signal received by the adapter unit 7" from the conductor device 6. In both cases, the output signal resulting from the interpretation is transferred at the joint 4040. The output signal can be converted e.g. by means of a pulse-width modulation or pulse-pause modulation.

Cumbersome separate cabling of the indirect lighting module 40 at the construction site can be avoided with the aid of the contact devices 1017*a*, 1047 described above and the cooperation therebetween. A comparatively small passage-opening 50 is introduced into the web 3*a* in the region of the top side of the rail 3". The opening 50 can either be pre-produced or flexibly introduced at the desired position at the construction site. The freely placeable adapter 7" which can initially be displaced with folded-in contact elements 13 is then positioned in the rail 3" under the recess 50. Indirect lighting modules 40 can then be inserted e.g. quickly, variably and flexibly without much effort. In addition, the indirect lighting module 40, and optionally further indirect lighting modules 40*a* as "slaves", can still be displaced in the longitudinal direction L relative to the adapter unit 7" when an electrical coupling is provided. For example, a further module 40*a* can be provided at each end of the module 40, wherein an indirect lighting strip of greater length is likewise feasible.

In the manner described above, the adapter unit 7" serves as a coupling unit 7" for coupling the conductor device 6 to the indirect lighting module 40.

Figure 15:
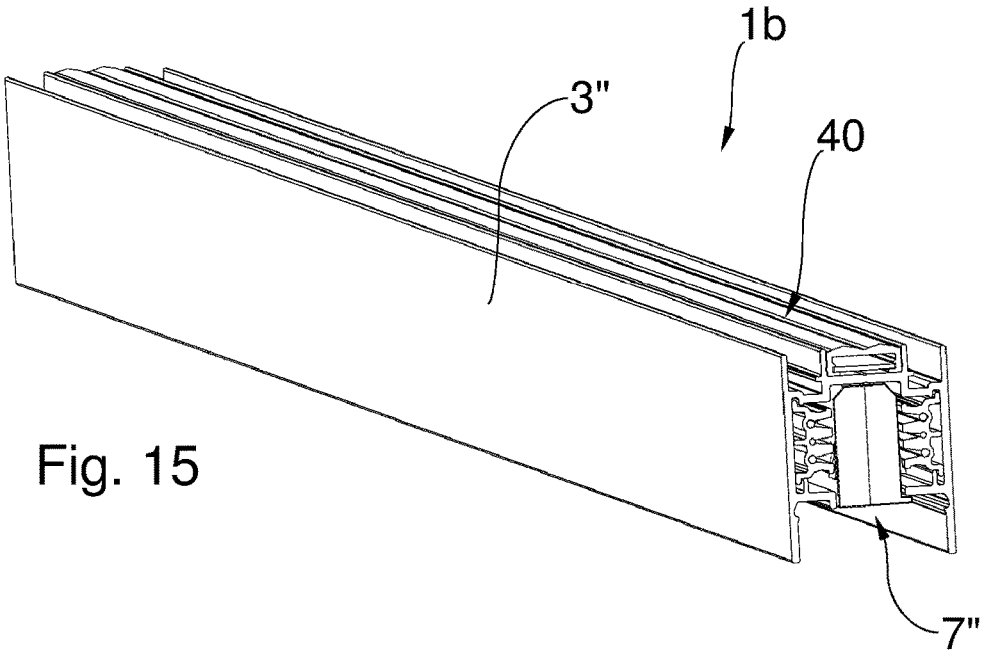
FIG. 15 shows the components of FIG. 14 in a state mounted on one another, as seen in perspective from a rear side of the lighting arrangement facing away from the visible side.
Figure 17:
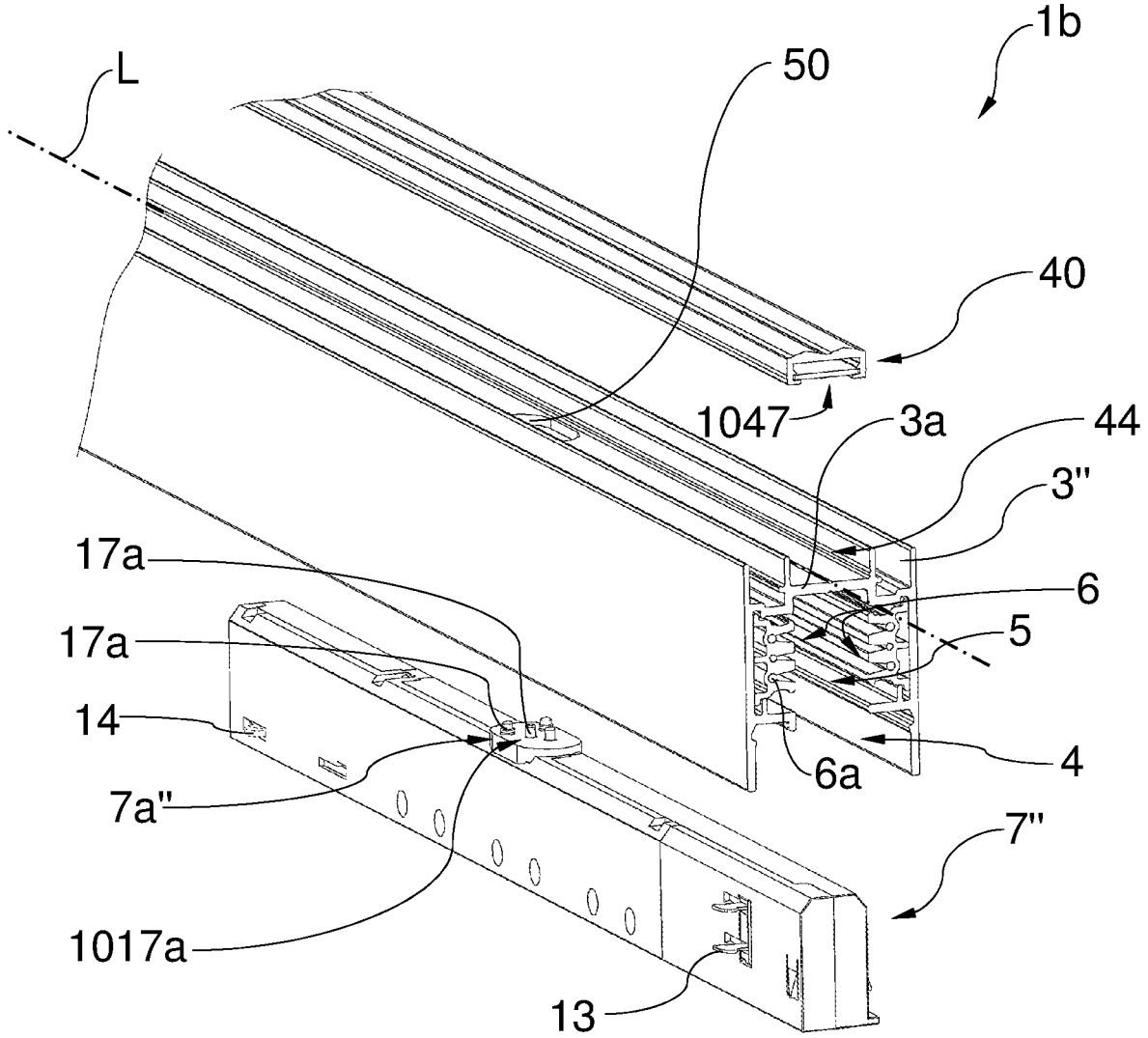
FIG. 17 shows some of the components in FIG. 14 in a perspective exploded view from the rear side.
Figure 18:
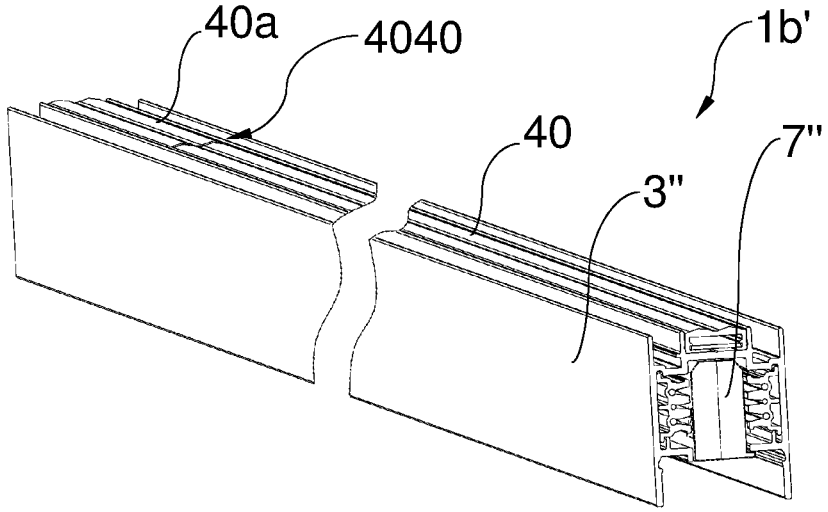
FIG. 18 shows a variant of the third exemplified embodiment of FIGS. 14-17, illustrated in a similar manner to FIG. 15.

The adapter unit 7" is configured to supply the indirect module 40 and optionally, in the case of the arrangement 1*b*', further indirect modules 40*a* in the accommodating region 44 as "slaves". In addition to the adapter unit 7", in FIGS. 14-18 a further adapter unit 7, which is not visible in FIGS. 15, 17, 18, is accommodated in the inner region 5 of the rail 3" and is designed as described with reference to FIGS. 1-4. By means of the further adapter unit 7, one or more linear lighting modules 11, 11*a* can be supplied as assemblies 2, 12 in a similar manner to FIGS. 1-3 in order to also implement direct lighting by means of the lighting arrangement 1*b*, 1*b*', i.e. in particular starting from the visible side S into the room region located therebelow. With such an arrangement 1*b*, 1*b*', continuous direct and indirect lighting strips can be produced e.g. simultaneously and can be displaced separately along the rail 3".

Figure 14:
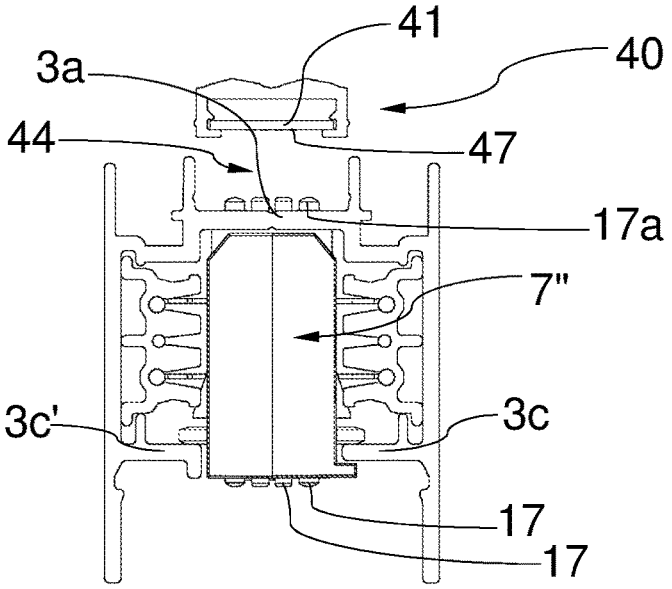
FIG. 14 shows some components of a lighting arrangement according to a further exemplified embodiment, in a state partially mounted on one another, in an end-face view.
Figure 16:
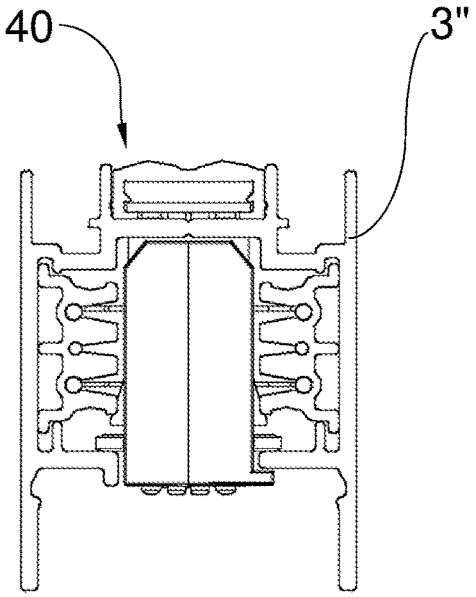
FIG. 16 shows the situation of FIG. 15 in an end-face view.

FIGS. 14, 16 show the end face of the rail 3" with, by way of example, two adapter units 7, 7"—of which one is for direct modules and one is for indirect modules—wherein, with the exception of the contact elements 17, only the foremost adapter unit 7" is visible and conceals the adapter unit 7 arranged therebehind.

As in the case of the lighting arrangements described above with reference to FIGS. 1-13, in the exemplified embodiment of FIGS. 14-18, the region 4, which is provided for accommodating, at least partially and preferably substantially completely, the assembly(ies) 2, 12, which are configured preferably for direct lighting, is formed as a front-side region 4 of the rail 3" when the lighting arrangement 1*b*, 1*b*' is in the usage state. The front side of the lighting arrangement 1*b* or 1*b*' corresponds to the visible side S thereof, in particular the underside thereof in a mounted state.

The accommodating region 44 for accommodating, at least partially, preferably substantially completely, the indirect lighting module 40 as well as optionally the extension indirect lighting module 40*a* is formed as a rear-side region 44 of the rail 3". The accommodating region 44 and the inner region 5 are thus arranged on different sides of the web 3*a*, wherein the inner region 5 is provided between the web 3*a* and the region 4. The rear-side accommodating region 44 and the inner region 5 are thus adjacent to to one another in the exemplified embodiment of FIGS. 14-18 and in this case are delimited from one another by the web 3*a*.

It should be mentioned that the contact devices 1017*a*, 1047 described above with respect to exemplified embodiments enable simple and quick, displaceable electrical coupling which advantageously requires little effort and time during mounting and is also space-saving.

However, in one modified variant, the contact devices 1017*a*, 1047 can be replaced by a cable connection, wherein a sufficient cable length is provided in order to enable the indirect lighting module 40 and optionally the extension indirect lighting module 40*a* to be displaced relative to the inserted adapter unit 7". The cable connection can be formed e.g. with a flexible cable which is connected at one end thereof to the contact section 7*a*" and at its other end to the indirect lighting module 40 and extends through the opening 50.

Some possibilities are presented above for constructing a lighting arrangement based on the rail lighting system described above, wherein the different assemblies, lighting modules, lighting units, indirect lighting modules, and rail profiles described above can be combined in many ways in order in each case to meet the lighting requirement in different applications.

In particular, the indirect lighting module(s) 140, 140*a* of FIGS. 14-18 can be combined in a versatile manner with the direct lighting modules 11, 11*a* or lighting units 211*a*, 211*b* described with reference to FIGS. 1-13. For example, it is possible in this manner to provide both directly and indirectly illuminating lighting strips which independently of each other in the inserted state have a displaceability with respect to the respectively provided adapter unit 7" or 7 or 7'.

As described above, a dedicated adapter unit is not necessary for extension rails 9, see FIG. 13, or extension modules 11*a*, 40*a*, see FIGS. 3 and 18.

However, a specifically provided adapter unit is preferably provided in each case for the differently designed assemblies 2, 12 and for the indirect lighting. For the lighting modules 11, 11*a*, for the low-voltage rails 9 with lighting units 211*a*, 211*b*, and for the indirect lighting by means of the indirect lighting modules 40, 40*a*, the rail lighting system provides a specifically configured adapter unit 7, 7', 7" in each case. In particular with regard to basic shape and dimensions as well as the fastening in the second region 5 and the contacting with the conductor device 6, the adapter units 7, 7', 7" are designed substantially similarly.

Therefore, a first adapter unit 7" is used preferably e.g. for a lighting arrangement having indirect lighting modules 40, 40*a* and a second, independent adapter unit 7 e.g. next to the first adapter unit 7" is used for additional directly illuminating lighting modules 11, 11*a* in the rail 3". In order to combine the indirect lighting modules 40, 40*a* with an assembly 2 with the low-voltage rail 9, a second adapter unit 7' can be used in addition to the adapter unit 7". This makes it possible to flexibly combine direct or indirect illuminating components and at the same time the complexity of the adapter units 7, 7', 7" in terms of electrical and control technology is limited.

Furthermore, the rail system can provide an independent adapter unit, not shown in the figures, for spot lamps or spotlights, not shown.

It is feasible e.g. on the adapter or coupling unit 7", to simultaneously provide contact elements 17*a* for supplying an indirect lighting module 40 and contact elements 17 for supplying modules 11, 11*a*. Similarly, it would be feasible to provide contact elements 17*a* for an indirect module 40 on the adapter unit 7'. In such a modification, only one adapter unit is required instead of two, although it is constructed in a more complicated manner in terms of electrical and control technology, particularly if direct and indirect lighting are to be controlled independently of one another.

The adapter units 7, 7" described above can each be equipped with different numbers of contact elements 17 or 17*a*. For example, the adapter unit 7 or 7" could have three or four punctiform contact elements 17 or 17*a*, wherein a corresponding number of contact elements 18 or 47 can then be provided.

For example, three pin contacts 17 or 17*a*, variants and exemplified embodiments can serve to provide the possibility of a so-called "Tunable White", wherein the pin contacts 17, 17*a* provide positive and negative current contacts for this purpose. In this case, the contact elements 17, 17*a* can have the following configuration: first contact element positive (cold); second contact element positive (warm); third contact element negative.

In one variant, in which the "Tunable White" option is not available, it may be sufficient to provide the adapter units 7, 7" each with only two contact elements, with the configuration: first contact element positive, second contact element negative.

Therefore, a rail lighting system is described above which enables combinable accommodation of displaceable spotlights, lighting modules and low-current rails which themselves can accommodate further lighting units, in particular in a displaceable manner, in a three-phase or five-phase rail.

A lighting arrangement 100 according to a further exemplified embodiment and a variant 100' thereof are shown in FIGS. 19-24. The lighting arrangement 100 comprises a rail 109, at least one indirect lighting module 140 for providing indirect lighting, and an adapter or coupling unit 108.

Figure 19:
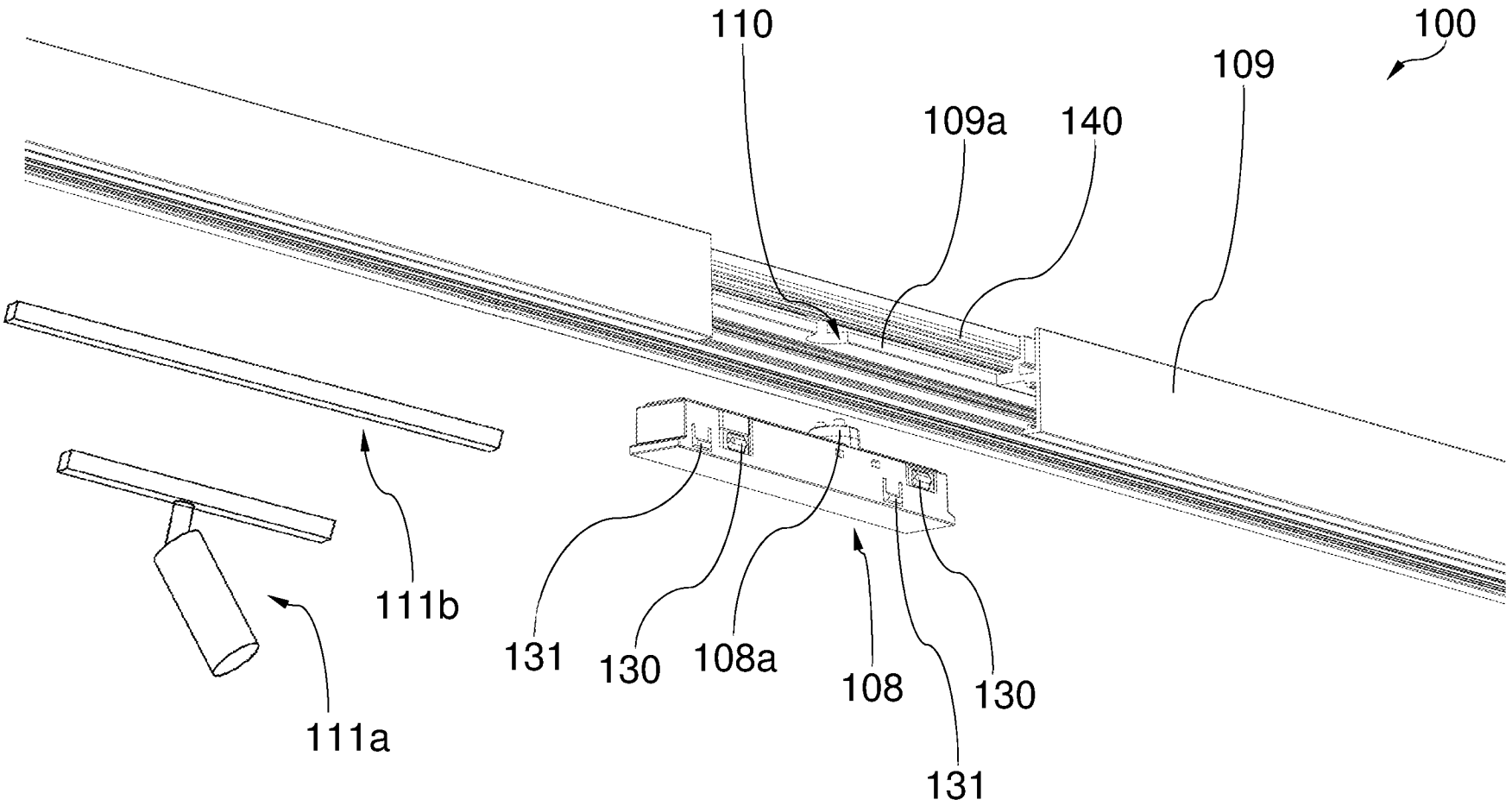
FIG. 19 shows a lighting arrangement according to a still further exemplified embodiment, as seen partially in an exploded view and partially cut away, from a visible side.

The rail 109 is designed for coupling and/or accommodating, at least partially, one or more lighting units 111*a* and/or 111*b* which are illustrated schematically in FIG. 19 and can be of a different type, can be designed e.g. as linear modules 111*b* or spots 111*a*.

Figure 23:
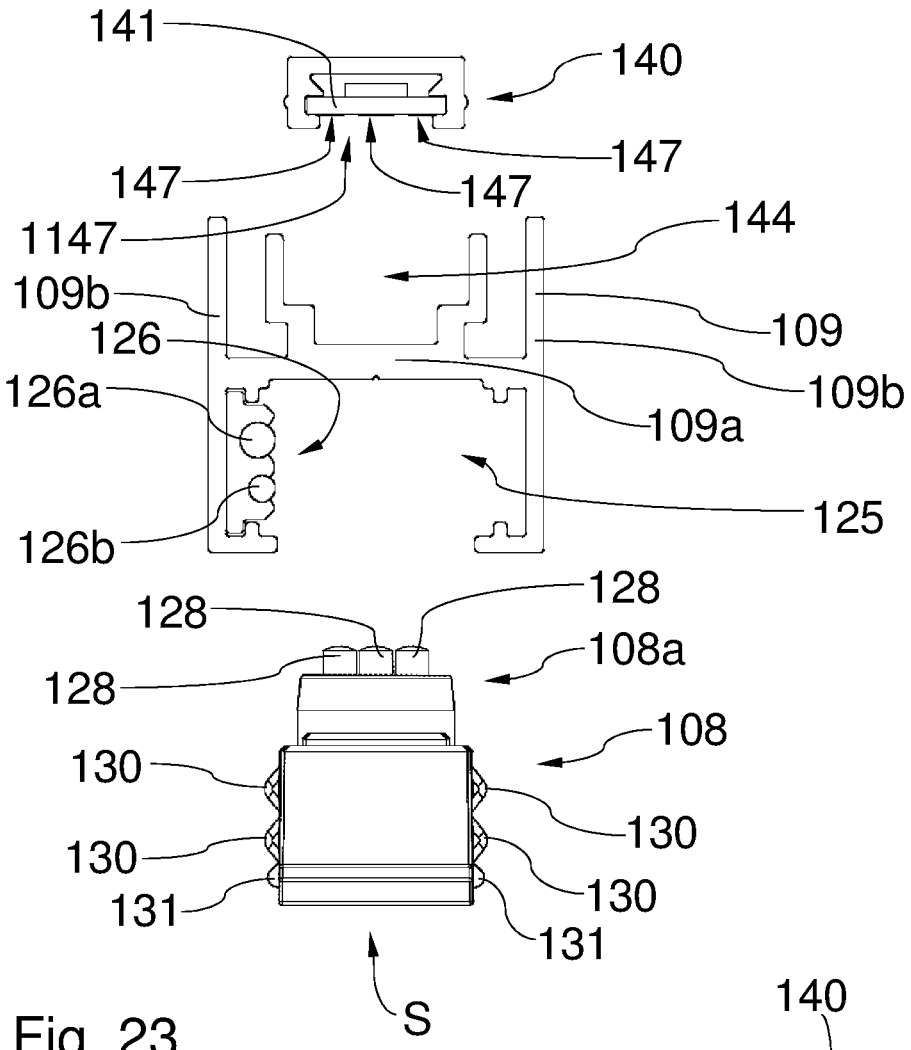
FIG. 23 shows an end-face exploded view of the lighting arrangement of FIG. 19.
Figure 24:
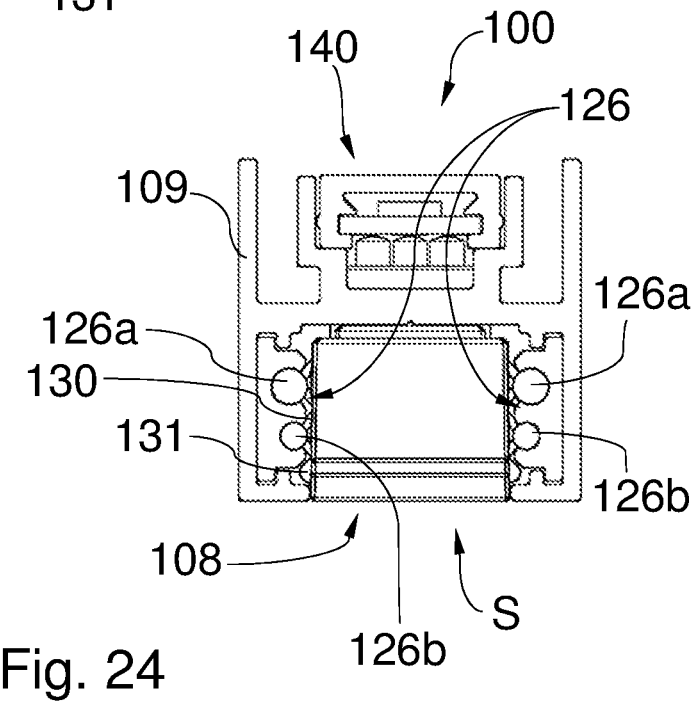
FIG. 24 shows an end-face view of the lighting arrangement of FIG. 19 in the mounted state.

The rail 109 has a first region 144 and a second region 125, see the cross-sectional view of FIG. 23. In the inner region 125, the lower one in FIG. 23, a conductor device 126 is provided along the rail 109 for providing at least electrical energy for supplying the lighting unit(s) 111*a*, 111*b*. The conductor device 126 extends in parallel with a longitudinal direction L' of the rail 109. FIGS. 23, 24 show that the conductor device 126 is designed having two conductor rails, each with two conductors 126*a*, 126*b*, of which one conductor rail is on each side of the inner region 125 laterally within the same, wherein the conductors 126*a* serve to provide the electric current and the conductors 126*b* serve to provide a control signal, for instance a DALI signal, wherein a control signal based on e.g. another protocol or dimming method is likewise feasible. If e.g. a control signal is not desired, the conductor device 6 could alternatively be designed having only one conductor rail on one side, and with a total of two conductors.

The rail 109 is designed as a low-voltage or low-volt rail, e.g. for supplying energy to the lighting units with a direct voltage of less than 60V, e.g. 48V, which is fed into the conductor device 126 by a feed unit, not shown.

The adapter unit 108 may also be referred to as a coupling or connecting unit, serves to electrically couple the conductor device 126 to the indirect lighting module 140, can be inserted into the inner region 125 of the rail 109 and can be coupled to the rail 109. When the coupling unit or adapter unit 108 is in the inserted state, the conductors 126*a*, 126*b* are arranged laterally of the unit 108.

Figure 20:
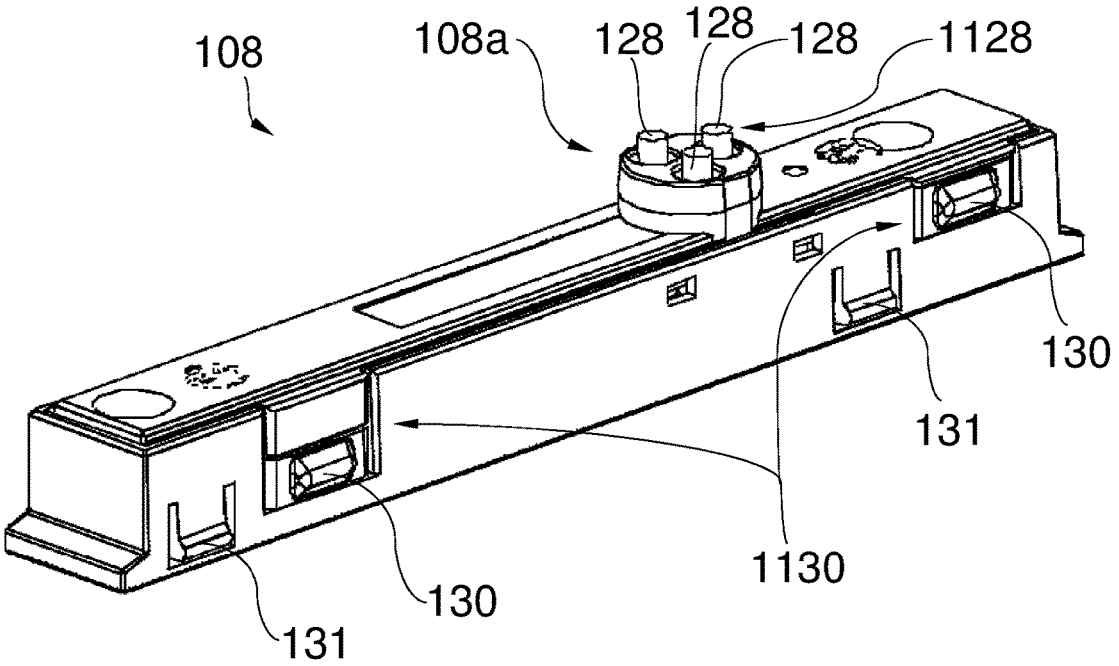
FIG. 20 shows a coupling or adapter unit of the lighting arrangement of FIG. 19.
Figure 21:
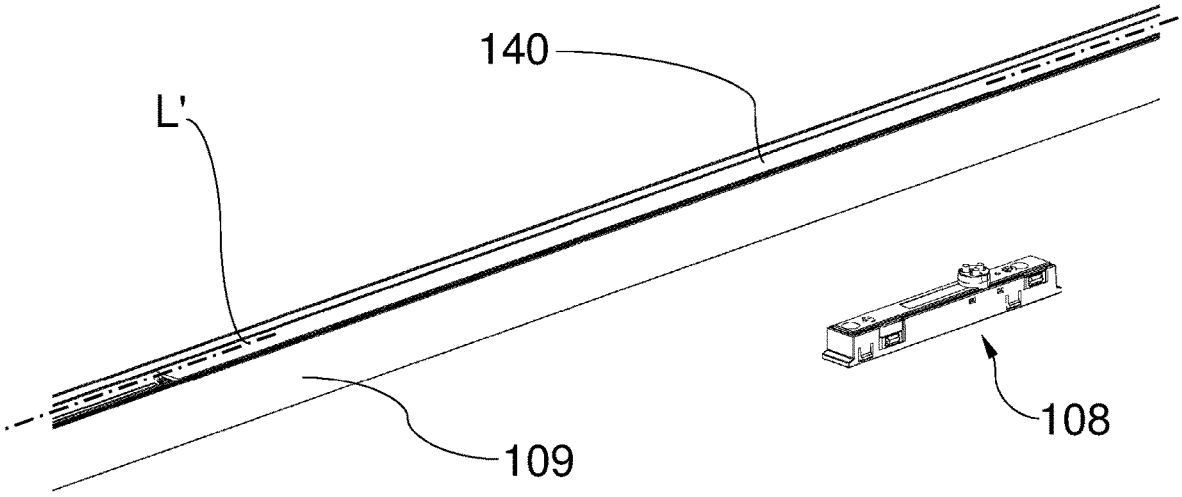
FIG. 21 shows the lighting arrangement of FIG. 19 in a further perspective view, as seen from a rear side.

The coupling unit or adapter unit 108 shown separately in FIG. 20 has a first contact device 1130 with contact elements 130 arranged on the longitudinal sides of the unit 108. The contact elements 130 are arranged and configured to make electrically conductive contact in each case with one of the conductors 126*a*, 126*b*. In addition, the coupling unit 108 has, on the longitudinal sides thereof, elastically resilient latching elements 131, by means of which the unit 108 can be clipped into the rail 109 for mechanical coupling thereof to the rail 109 from the visible side S thereof.

The adapter unit 108 is thus configured to tap current from the conductors 126*a* and preferably also control signals from the conductors 126*b* at the side of the conductor device 126 by means of the contact elements 130, to divert them upwards by 90° and to make them available to the indirect lighting module 140.

A cross-sectional shape of the rail 109 is formed having a web 109*a* and side walls or flanges 109*b*, wherein the web 109*a* extends between the flanges 109*b*. The web 109*a* defines the inner, second region 125 of the rail 109 which is equipped with the conductor device 126.

The rail 109 is fastened in a suspended manner to form the lighting arrangement 100, e.g. in a building, e.g. by suspending the rail 109 from a ceiling, from another part of the building, or from another construction.

The first region 144, hereinafter also referred to as the accommodating region 144, is arranged on a rear side of the rail 109 which, in the mounted state, faces away from a visible side S of said rail, and thus on the rear side of the web 3*a*. The accommodating region 144 is formed in the cross-sectional profile of the rail 109, in particular as an upper part of a channel facing away from the web 109*a* and the inner region 125. The channel has two sections of different width starting from the opening thereof towards the web 109*a* and is of smaller width by reason of inwardly protruding, lateral steps towards the web 109*a*.

The accommodating region 144 serves to accommodate an assembly designed as an elongated indirect lighting module 140, which can be inserted—in FIGS. 23, 24 from above—into the accommodating region 144. In the mounted state, the indirect lighting module 140 inserted into the first region 144 can emit light upwards, e.g. in the direction of the ceiling of the room.

In order to supply electrical current and preferably control signals to the indirect lighting module 140, the coupling unit 108 has a contacting section 108*a*. The rail 109 is provided with a passage-opening 110 in the region of the web 109*a*, see FIG. 19. When the coupling unit 108 is inserted into the rail 109, the contacting section 109 is inserted into and through the passage-opening 110 such that the upper part of the contacting section 108*a* passes through the passage-opening 110 to supply electrical current and preferably also control signals to the indirect lighting module 140.

The indirect lighting module 140 has a double-sided printed circuit board 141. Elongated strip-shaped contact elements 147 of a contact device 1147 of the module 140, which extend in parallel with the longitudinal direction L' and are designed as tracks, are formed on a main surface of the printed circuit board 141 facing the web 109*a* in the state in which it is inserted into the accommodating region 144. On the other, opposite main surface, the printed circuit board 141 is provided with light-generating devices which are designed preferably as LEDs.

A second contact device 1128 is arranged on the contacting section 108*a* of the adapter unit 108 and has a plurality, in the example shown three, punctiform, pin-shaped or pin-head-like contact elements 128 which protrude from an upper surface of the contacting section 108*a* in the mounted state, see FIG. 20.

During insertion of the coupling unit 108, the second contact device 1128, comprising the contact elements 128, makes electrically conductive contact with the contact device 1147 of the indirect lighting module 140, comprising the contact elements 147. In particular, in this case each contact element 128 contacts one of the web-like contact elements 147.

Complex cabling of the indirect lighting module 140 is not necessary in the described embodiment with the cooperating contact devices 1128, 1147, the electrical coupling of the conductor device 126 to the indirect lighting module 140 is possible in a simple and time-saving manner. The passage-opening 110 which is relatively small in size can be pre-produced in the rail 109 or flexibly inserted on the construction site. Then, the indirect lighting module 140, and optionally further indirect lighting modules 140*a*, see the variant of FIG. 22, can be inserted quickly, variably and flexibly without much effort.

In addition, the punctiform contact elements 128 can slide on the web-like contact elements 147 in the contacting state, whereby the indirect lighting module 140 in the inserted state can be displaced relative to the coupling unit or adapter unit 108.

Figure 22:
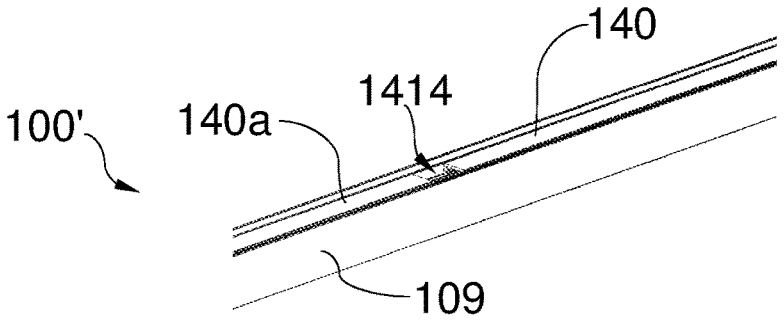
FIG. 22 shows a portion of the arrangement of FIG. 19, in a variant according to a still further exemplified embodiment.

FIG. 22 illustrates that in a lighting arrangement 100' according to one variant, the indirect lighting module 140 can form a first indirect lighting module 140 which can be electrically coupled to at least one extension indirect lighting module 140*a*. For this purpose, the extension indirect lighting module 140*a* can be inserted into the accommodating region 144 in the same way as the indirect lighting module 140. In this way, a joint 1414 is formed between the modules 140, 140*a*, which is not yet completely closed in FIG. 22. At the joint 1414, the modules 140 and 140*a* can be electrically coupled to one another in order to likewise supply electrical energy to the extension indirect lighting module 140*a* via the indirect lighting module 140 by means of the unit 108.

The modules 140 and 140*a* are controlled and operated according to a master-slave operation, wherein the module 140*a* as "slave" is subordinate to the module 140 as "master". In other words, the control of the extension indirect lighting module 140*a* is effected according to those control signals which the first indirect lighting module 140 receives from the adapter unit 108 and according to which the first indirect lighting module 140 is controlled and operated.

In the case of the exemplified embodiment of FIGS. 19-24, the preferably double-sided printed circuit board 141 ("PCB") of the first indirect lighting module 140 not only enables the supply of power to the module 140, but also interprets control signals which are relayed via the contact devices 1130, 1128 and 1147 from the conductor device 126 via the coupling unit 108 to the first module 140, and thus enables control, e.g. dimming. Via the end-face coupling with the module 140*a*, the module 140*a* ("slave") is also activated like the module 140. The control signal relayed by the conductors 126*b* is evaluated by means of devices of the first indirect lighting module 140 ("master"), wherein by means of these devices e.g. an output signal is generated based on the control signal, said output signal being used by the module 140 to control the same and is also relayed at the joint 1414 to the extension module 140*a* for control thereof. The output signal is e.g. a signal correlating with the dim level, e.g. based on pulse-width modulation or pulse-pause modulation. The modules 140, 140*a* can thus be controlled via a common address.

The further extension indirect lighting module(s) 140*a* can be attached to the module 140 so as to be connectable according to the above-described master/slave principle and therefore do not require a dedicated coupling unit. It is feasible to have at least one extension module 140*a* at each end of the module 140.

Reference is made to the fact that in the case of a similarly advantageous variant of the exemplified embodiment of FIGS. 19-24, instead of the contact devices 1147, 1128 a cable connection can be provided similarly as described above for the contact devices 1017*a*, 1047 of FIG. 17. The cable connection can be formed e.g. with a flexible cable which is connected at one end thereof to the contacting section 108*a* and at its other end to the indirect lighting module 140 and extends through the opening 110.

The rails 3, 3', 3", 9, 109 can each be extruded e.g. from a metal material, e.g. an aluminium material. Rails made from aluminium material can be processed satisfactorily locally by fitters at the construction site using relatively simple means.

Although the invention has been described in full above with the aid of preferred exemplified embodiments, it is not limited thereto but can be modified in diverse ways.

LIST OF REFERENCE SIGNS

1, 1' lighting arrangement
1*a*, 1*a'*, 1*a"* lighting arrangement
1, 1*b'* lighting arrangement
2 assembly
3, 3" rail
3*a* web
3*b* flange
3*c*, 3*c'* longitudinal rib

4 first region
4*a* recess
5 second region
6 conductor device
6*a*, 6*b* conductor
7, 7', 7" adapter unit, coupling unit
7*a'* protrusion
7*a"* contacting section
8, 8' connecting unit, coupling unit
8*a*, 8*a'* contacting section
9 rail
9*a* web
9*b* inner region
10, 10' passage-opening
11 lighting module
11*a* further lighting module
12 further assembly
1202 joint
13 contact element
14 engagement element
15 device
16 latching device
17, 17*a*, 18 contact element
21 double-sided printed circuit board
25 inner region
26 conductor device
26*a*, 26*b* conductor
27, 28, 30 contact element
31 latching element
40 indirect lighting module
40*a* extension indirect lighting module
4040 joint
41 printed circuit board
44 accommodating region
47 contact element
50 passage opening
100, 100' lighting arrangement
108 adapter unit or coupling unit
108*a* contacting section
109 rail
109*a* web
109*b* flange
110 passage opening
111*a*, 111*b* lighting unit
125 inner region
126 conductor device
126*a*, 126*b* conductor
128, 130 contact element
131 latching element
140 indirect lighting module
141 printed circuit board
144 accommodating region
147 contact element
140*a* extension indirect lighting module
1414 joint
211*a*, 211*b* lighting unit
L, L' longitudinal direction
S visible side

The invention claimed is:

1. A lighting arrangement comprising:

a rail including side walls and a web provided with an opening and extending between the side walls, and a plurality of conductors extending along the rail; and a coupling unit configured to be inserted into the rail;

wherein the coupling unit includes a first contact device configured to electrically contact at least some of the conductors, and a contacting section configured to be received in the opening of the web when the coupling unit is inserted into the rail, and a second contact device arranged on the contacting section and configured to come into electrically conducting contact with a third contact device of an additional component having strip-like contact elements.

2. A lighting arrangement comprising:

a rail having an inner region, a web delimiting the inner region at one end thereof, and an opening provided in the web;

a conductor device provided in the inner region and configured to provide electrical energy;

a coupling unit having a contacting section configured to pass through the opening in the web; and at least one lighting module configured to be received in an accommodating region of the rail, wherein the coupling unit is configured to be received by the rail, to electrically connect to the conductor device for receiving electrical energy, and to supply the lighting module with electrical energy, and wherein the coupling unit and the lighting module are configured and arranged to enable the lighting module to be displaced in a longitudinal direction of the rail relative to the coupling unit.

3. The lighting arrangement of claim 2, wherein the lighting module is configured to provide indirect lighting.

4. A lighting arrangement comprising:

a rail having an inner region, a web delimiting the inner region at one end thereof, side walls of the rail extending from opposite ends of the web, an accommodating region, and an opening provided in the web;

a conductor device provided in the inner region and configured for providing electrical energy;

a coupling unit having a contacting section configured to pass through the opening in the web, and contact elements; and at least one first lighting module configured to be received in the accommodating region of the rail, the first lighting module comprising elongated contacts extending in a longitudinal direction of the rail when the first lighting module is received in the accommodating region, wherein the coupling unit is configured to be received by the rail, to electrically connect to the conductor device for receiving electrical energy, and to supply the first lighting module with electrical energy by contact of the contact elements of the coupling unit with the elongated contacts of the first lighting module.

5. The lighting arrangement of claim 4, wherein the coupling unit and the first lighting module are configured and arranged to enable the first lighting module be displaced in a longitudinal direction of the rail relative to the coupling unit.

6. The lighting arrangement of claim 4, wherein the contact elements are punctiform contact elements.

7. The lighting arrangement of claim 4, wherein the first lighting module further comprises a double-sided printed circuit board, wherein the elongated contact elements are formed as tracks on a main surface of the printed circuit board.

8. The lighting arrangement of claim 4, wherein the conductor device includes a plurality of conductors located laterally in the inner region of the rail, such that when the coupling unit is inserted into the inner region of the rail, the coupling unit electrically contact at least some of the conductors.

9. The lighting arrangement of claim 4, wherein the conductor device is configured to carry a voltage of less than 60 volts or a mains voltage.

10. The lighting arrangement of claim 4, wherein the rail is configured to be suspended.

11. The lighting arrangement of claim 4, wherein the accommodating region extends away from the inner region, and the first lighting module is configured to be inserted into the accommodating region.

12. The lighting arrangement of claim 4, wherein the coupling unit is configured to receive a control signal from the conductor device and transmit the control signal to the first lighting module, the first lighting module being configured to interpret the control signal.

13. The lighting arrangement of claim 4, wherein the first lighting module is configured to provide indirect lighting.

14. The lighting arrangement of claim 4, wherein the coupling unit is configured to receive a control signal from the conductor device, and one of transmitting the control signal to the first lighting module or interpreting the received control signal to control the first lighting module.

15. The lighting arrangement of claim 14, further comprising at least one extension lighting module, wherein the first lighting module is configured to be coupled to the extension lighting module such that the extension lighting module is controlled via the first lighting module.

16. The lighting arrangement of claim 4, further comprising at least one extension lighting module, wherein the first lighting module is configured to be electrically coupled to the extension lighting module such that the extension lighting module is supplied with electrical energy by the first lighting module.

17. The lighting arrangement of claim 16, wherein the extension lighting module is configured to provide indirect lighting.

* * * * *